US007717824B2

(12) United States Patent
Pinto

(10) Patent No.: US 7,717,824 B2
(45) Date of Patent: May 18, 2010

(54) ISOKINETIC EXERCISE EQUIPMENT

(76) Inventor: Itzhak Pinto, P.O. Box 3836, 49130 Petach Tikva, Petach Tikva (IL)

( * ) Notice: Subject to any disclaimer, the term of this patent is extended or adjusted under 35 U.S.C. 154(b) by 0 days.

(21) Appl. No.: 11/937,314

(22) Filed: Nov. 8, 2007

(65) Prior Publication Data

US 2009/0124461 A1 May 14, 2009

(51) Int. Cl.
*A63B 24/00* (2006.01)

(52) U.S. Cl. ..... 482/7; 482/57; 482/62; 482/138

(58) Field of Classification Search ..... 482/7, 482/57, 62, 135–138; 601/26, 32, 35, 36
See application file for complete search history.

(56) References Cited

U.S. PATENT DOCUMENTS

| | | | | | |
|---|---|---|---|---|---|
| 363,522 | A | * | 5/1887 | Knous | 74/594.1 |
| 2,261,355 | A | * | 11/1941 | Flynn | 601/26 |
| 2,675,236 | A | | 4/1954 | Blickman | |
| 3,759,512 | A | * | 9/1973 | Yount et al. | 482/62 |
| 3,824,993 | A | * | 7/1974 | Grant | 601/36 |
| 3,964,742 | A | * | 6/1976 | Carnielli | 482/7 |
| 3,991,749 | A | * | 11/1976 | Zent | 601/36 |
| 4,402,502 | A | * | 9/1983 | Peters | 601/36 |
| 4,436,097 | A | * | 3/1984 | Cunningham | 600/520 |
| 4,550,908 | A | | 11/1985 | Dixon | |
| 4,572,501 | A | * | 2/1986 | Durham et al. | 482/60 |
| 4,660,826 | A | | 4/1987 | Lee et al. | |
| 4,673,178 | A | | 6/1987 | Dwight | |
| 4,705,269 | A | * | 11/1987 | DeBoer et al. | 482/62 |
| 4,846,156 | A | * | 7/1989 | Kopnicky | 601/36 |
| 4,860,763 | A | | 8/1989 | Schminke | |
| 4,865,315 | A | * | 9/1989 | Paterson et al. | 482/5 |
| 4,928,673 | A | * | 5/1990 | Heneger | 601/36 |
| 4,934,692 | A | * | 6/1990 | Owens | 482/63 |
| 4,976,426 | A | * | 12/1990 | Szabo et al. | 482/6 |
| 4,993,407 | A | | 2/1991 | Chen et al. | |
| 5,016,870 | A | * | 5/1991 | Bulloch et al. | 482/62 |
| 5,265,589 | A | * | 11/1993 | Wang | 601/35 |
| 5,378,209 | A | | 1/1995 | Kendrew | |
| 5,496,236 | A | * | 3/1996 | Buonauito | 482/57 |
| 5,839,995 | A | * | 11/1998 | Chen | 482/92 |
| 5,853,353 | A | | 12/1998 | Blumel et al. | |
| 5,951,442 | A | * | 9/1999 | Adams et al. | 482/57 |
| 5,967,610 | A | | 10/1999 | Lin et al. | |
| 6,443,877 | B1 | * | 9/2002 | Hoecht et al. | 482/103 |
| 6,533,708 | B2 | * | 3/2003 | Taggett | 482/62 |
| 6,593,710 | B2 | * | 7/2003 | Reck | 318/1 |
| 6,652,425 | B1 | * | 11/2003 | Martin et al. | 482/57 |
| 7,306,548 | B2 | * | 12/2007 | Martin et al. | 482/92 |
| 7,354,384 | B2 | * | 4/2008 | Martin et al. | 482/92 |
| 2005/0015118 | A1 | | 1/2005 | Davis et al. | |

FOREIGN PATENT DOCUMENTS

| | | |
|---|---|---|
| DE | 3725317 | 2/1988 |
| FR | 2558064 | 7/1985 |
| GB | 2156693 | 10/1985 |

* cited by examiner

*Primary Examiner*—Fenn C Mathew
*Assistant Examiner*—Andrew M Tecco
(74) *Attorney, Agent, or Firm*—Fish & Richardson P.C.

(57) ABSTRACT

Isokinetic rehabilitation apparatus including a motor-driven pedal assembly having associated therewith a pair of foot pedals and at least one hand engagement element and a computerized motor controller operative to drive the motor-driven pedal assembly at a generally constant, selectable speed, generally irrespective of the extent to which forces are applied to the pedal assembly.

10 Claims, 22 Drawing Sheets

FIG. 9A
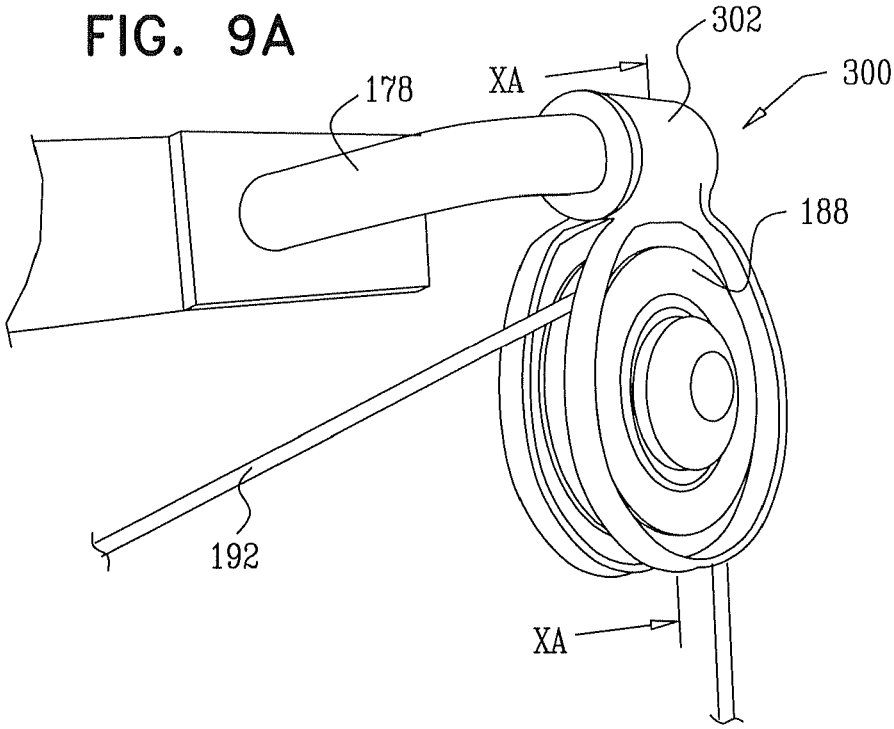
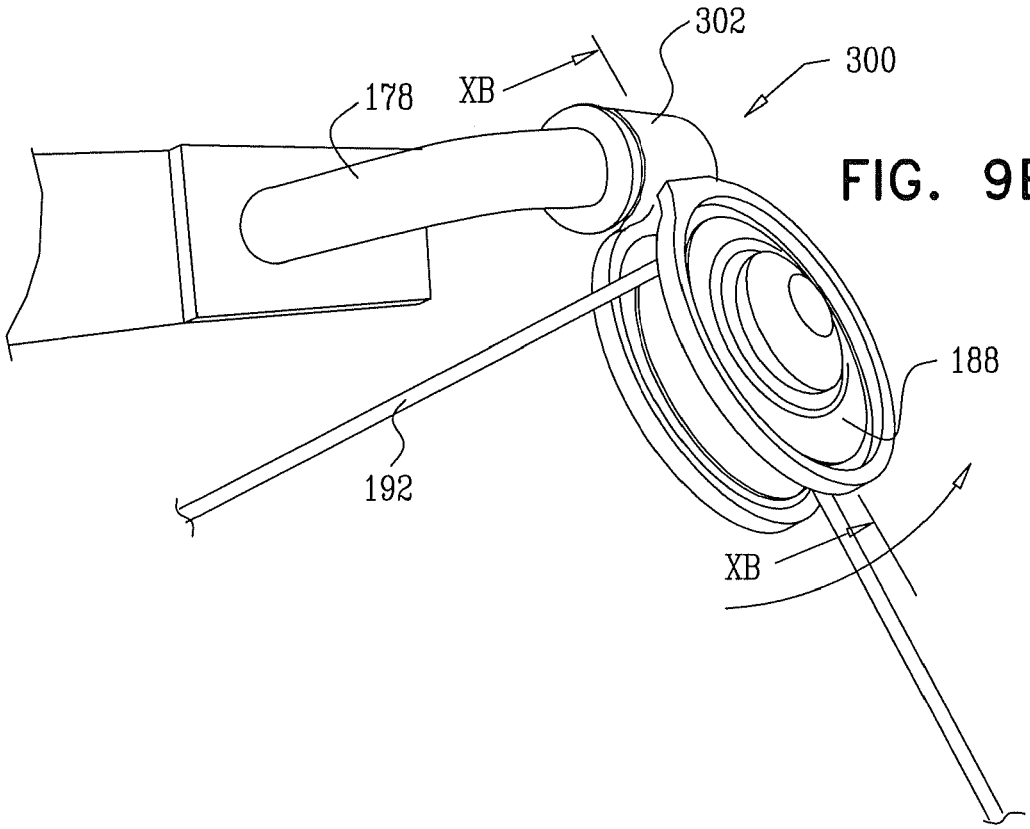
FIG. 9B

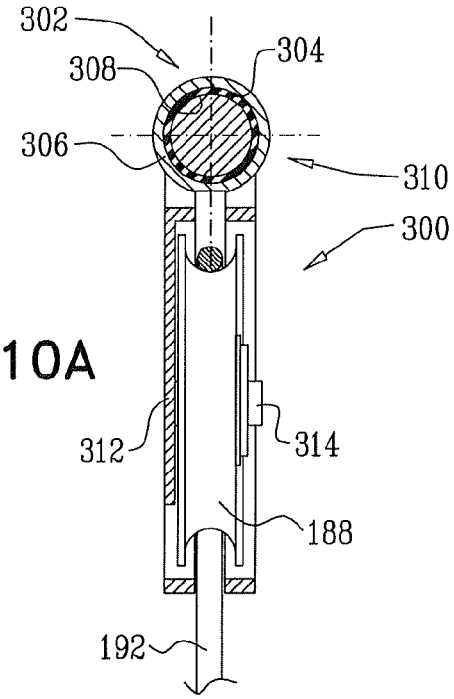
FIG. 10A
FIG. 10B
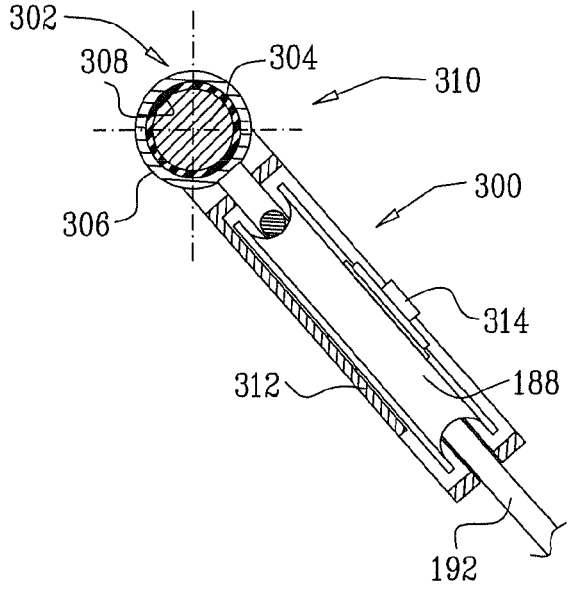

ISOKINETIC EXERCISE EQUIPMENT

FIELD OF THE INVENTION

The present invention relates to rehabilitation apparatus generally and more particularly to isokinetic rehabilitation apparatus.

BACKGROUND OF THE INVENTION

The following U.S. patents are believed to represent the current state of the art:

U.S. Pat. Nos. 5,496,236; 5,016,870; 4,860,763; 4,550,908 and 4,402,502

SUMMARY OF THE INVENTION

The present invention seeks to provide improved rehabilitation apparatus.

There is thus provided in accordance with a preferred embodiment of the present invention isokinetic rehabilitation apparatus including a motor-driven pedal assembly having associated therewith a pair of foot pedals and at least one hand engagement element and a computerized motor controller operative to drive the motor-driven pedal assembly at a generally constant, selectable speed, generally irrespective of the extent to which forces are applied to the pedal assembly.

Preferably, the motor-driven pedal assembly, the pair of foot pedals and the at least one hand engagement element are mounted onto a chassis which is selectably pivotable with respect to a base.

Preferably, the motor-driven pedal assembly, the pair of foot pedals and the at least one hand engagement element are mounted onto a chassis which is mounted on a base and the apparatus also includes a seat which is selectably positionable with respect to the base and which is rotatable with respect to the base. Additionally, the chassis is selectably pivotable with respect to the base. Additionally, the chassis is selectably pivotable with respect to the base between a first operative orientation, wherein the at least one hand engagement element is located between the chassis and the seat, and a second operative orientation, wherein the at least one hand engagement element is located on an opposite side of the chassis from the seat.

Preferably, the motor-driven pedal assembly, the pair of foot pedals and the at least one hand engagement element are mounted onto a chassis which includes a lower portion and an upper portion, the upper portion being selectably tiltable with respect to the lower portion and the apparatus also includes pulleys mounted both on the lower portion and on the upper portion and at least one cable extending in engagement with the pulleys connecting the at least one hand engagement element with at least one of the pair of foot pedals, whereby rotational motion of the foot pedal assembly results in reciprocal motion of the at least one hand engagement element along a reciprocal motion axis, whereby selectable tilting of the upper portion changes an orientation of the reciprocal motion axis.

Preferably, the motor-driven pedal assembly includes a foot pedal assembly axle, which is fixed to a toothed gear, driven in motion by a motor, first and second foot pedal support shafts, mounted onto the foot pedal assembly axle and first and second foot pedal mounting assemblies which rotatably support foot pedals and which are mountable onto the first and second foot pedal support shafts in two possible orientations, which correspond to positions of the foot pedals at two different distances from the foot pedal assembly axle.

Preferably, the computerized motor controller is operative to provide an output indication of resistance to rotation of the motor-driven pedal assembly at a generally constant speed. Additionally, the output indication is a real time operator readable output indication. Alternatively or additionally, the output indication is a summary operator readable output indication.

Preferably, the motor-driven pedal assembly, the pair of foot pedals and the at least one hand engagement element are mounted onto a chassis having pulleys mounted thereon and at least one cable extending in engagement with the pulleys connecting the at least one hand engagement element with at least one of the pair of foot pedals, whereby rotational motion of the foot pedal assembly results in reciprocal motion of the at least one hand engagement element along a reciprocal motion axis, at least one of the pulleys, being closest to the at least one hand engagement element being rotatable relative to the chassis about at least first and second mutually orthogonal axes.

Preferably, the motor-driven pedal assembly, the pair of foot pedals and the at least one hand engagement element are mounted onto a chassis which includes a lower portion and an upper portion, and the apparatus also includes pulleys mounted both on the lower portion and on the upper portion and at least one cable extending in engagement with the pulleys connecting the at least one hand engagement element with at least one of the pair of foot pedals, whereby at least one of the pulleys is constructed to permit disengagement of the at least one cable with the pulley, thereby changing an effective length of the at least one cable.

There is also provided in accordance with another preferred embodiment of the present invention a method for isokinetic rehabilitation of a user including engaging, by the user, a motor-driven pedal assembly having associated therewith a pair of foot pedals and at least one hand engagement element and employing a computerized motor controller to drive the motor-driven pedal assembly at a generally constant, selectable speed, generally irrespective of the extent to which the user applies forces to the pedal assembly.

Preferably, the method also includes pivoting the motor-driven pedal assembly, the pair of foot pedals and the at least one hand engagement element with respect to a base. Preferably, the method also includes selectably axially positioning a rotatable seat.

Preferably, the method also includes selectably tilting an upper portion of a chassis relative to a lower portion thereof in order to change an orientation of a reciprocal motion axis of a cable in engagement with pulleys mounted both on the lower portion and on the upper portion, which cable connects the at least one hand engagement element with at least one of the pair of foot pedals, whereby rotational motion of the foot pedal assembly results in reciprocal motion of the at least one hand engagement element along a reciprocal motion axis.

Preferably, the method also includes providing an output indication of resistance to rotation of the motor-driven pedal assembly at a generally constant speed. Preferably, the output indication is a real time operator readable output indication. Alternatively or additionally, the output indication is a summary operator readable output indication.

Preferably, the motor-driven pedal assembly, the a pair of foot pedals and the at least one hand engagement element are mounted onto a chassis having pulleys mounted thereon and at least one cable extending in engagement with the pulleys connecting the at least one hand engagement element with at least one of the pair of foot pedals, wherein reciprocal motion of the at least one hand engagement element along a reciprocal motion axis in engagement with at least one of the pulleys, being closest to the at least one hand engagement element producing rotation of the at least one of the pulleys relative to the chassis about at least first and second mutually orthogonal axes.

Preferably, the method also includes selectably axially positioning a rotatable seat and rotating the seat by the user during the reciprocal motion.

BRIEF DESCRIPTION OF THE DRAWINGS

The present invention will be understood and appreciated more fully from the following detailed description, taken in conjunction with the drawings in which:

FIGS. 9A and 9B are simplified pictorial illustrations of a pivotable pulley assembly preferably forming part of the apparatus of FIGS. 1A-1C;

FIGS. 10A and 10B are simplified sectional illustrations respectively taken along lines XA-XA and XB-XB in FIGS. 9A and 9B;

DETAILED DESCRIPTION OF A PREFERRED EMBODIMENT

Figure 1A:
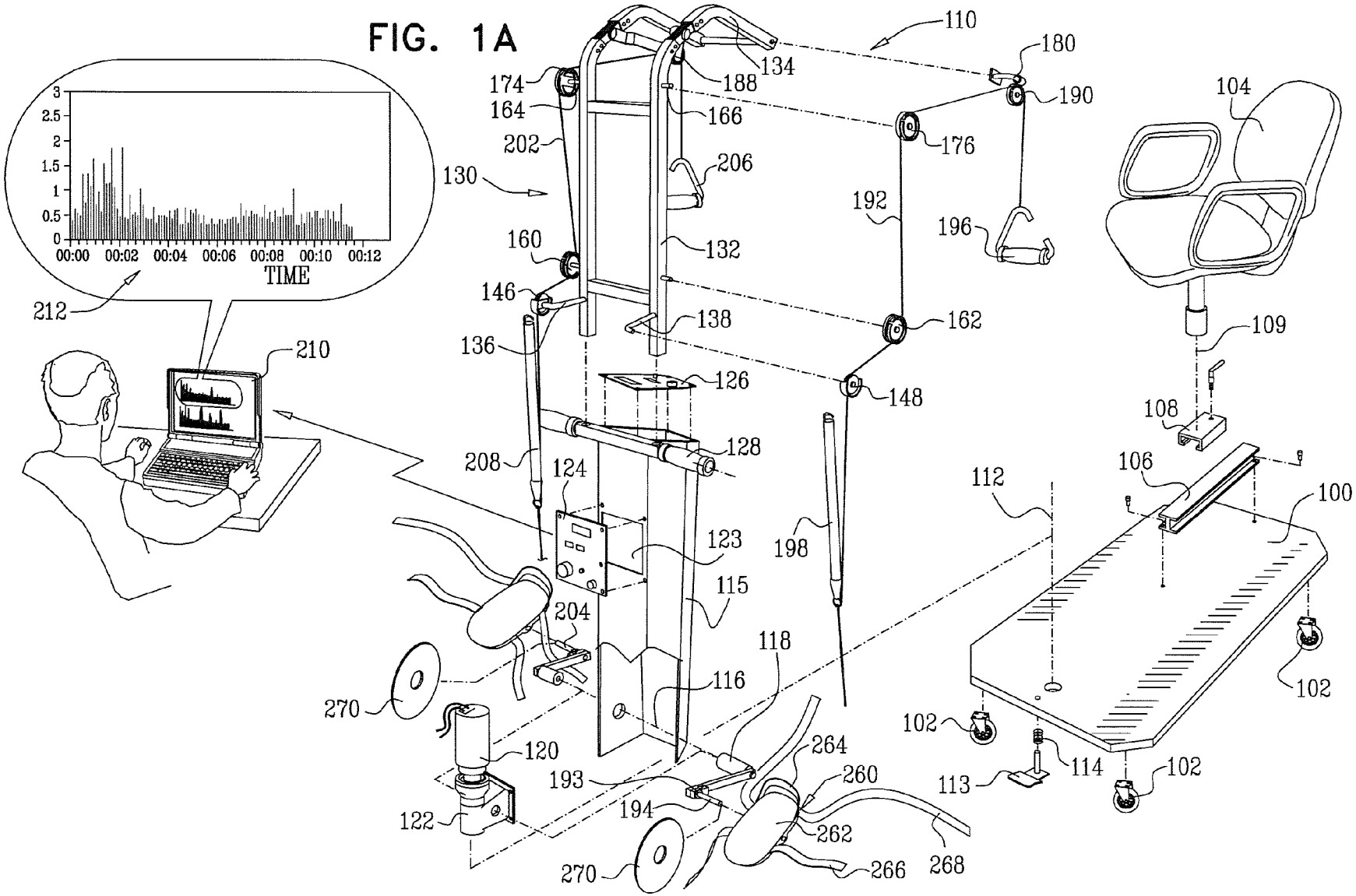
FIGS. 1A, 1B & 1C are simplified exploded view, partially assembled and fully assembled pictorial illustrations of rehabilitation apparatus constructed and operative in accordance with a preferred embodiment of the present invention.
Figure 1B:
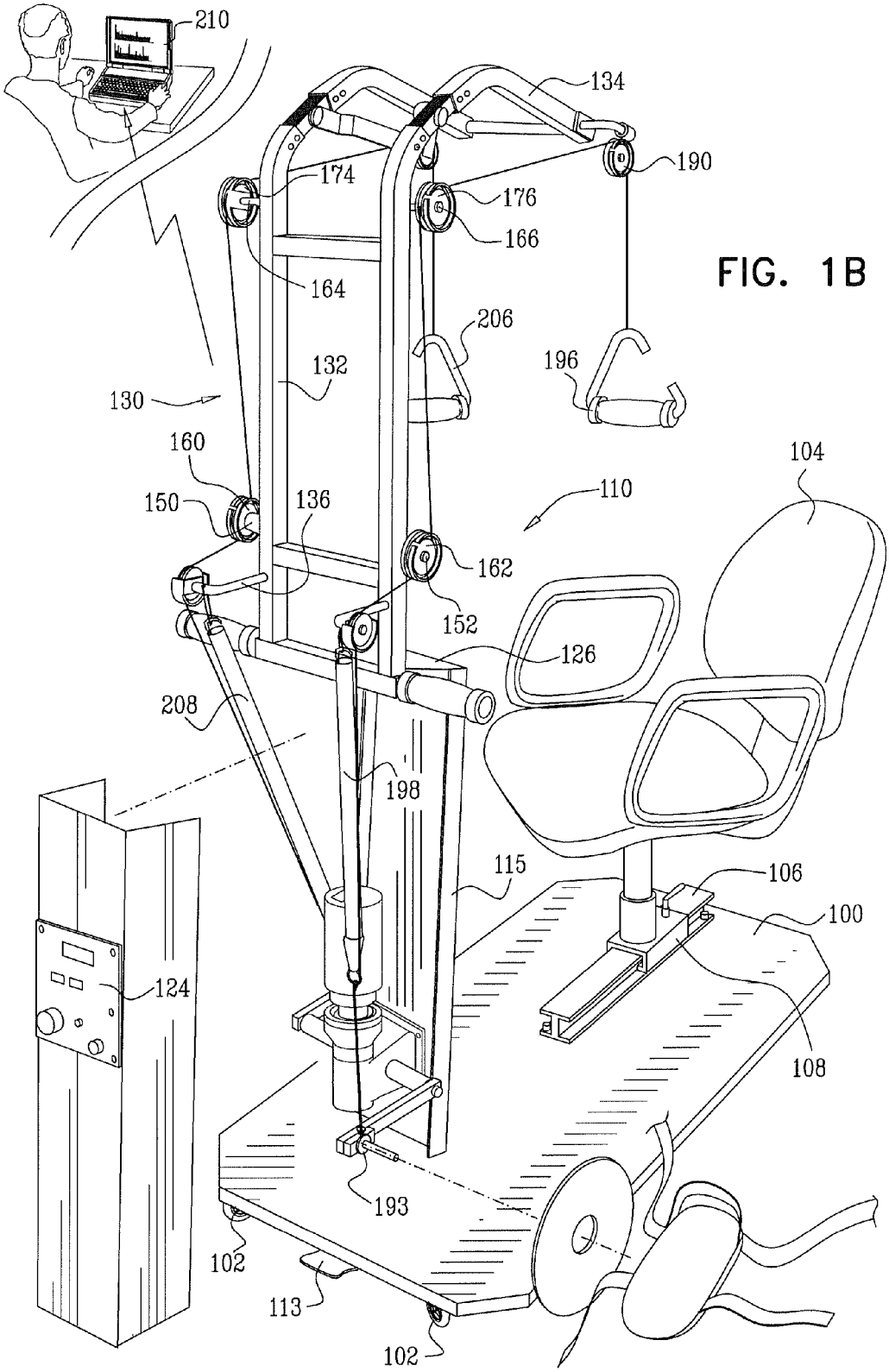
Figure 1C:
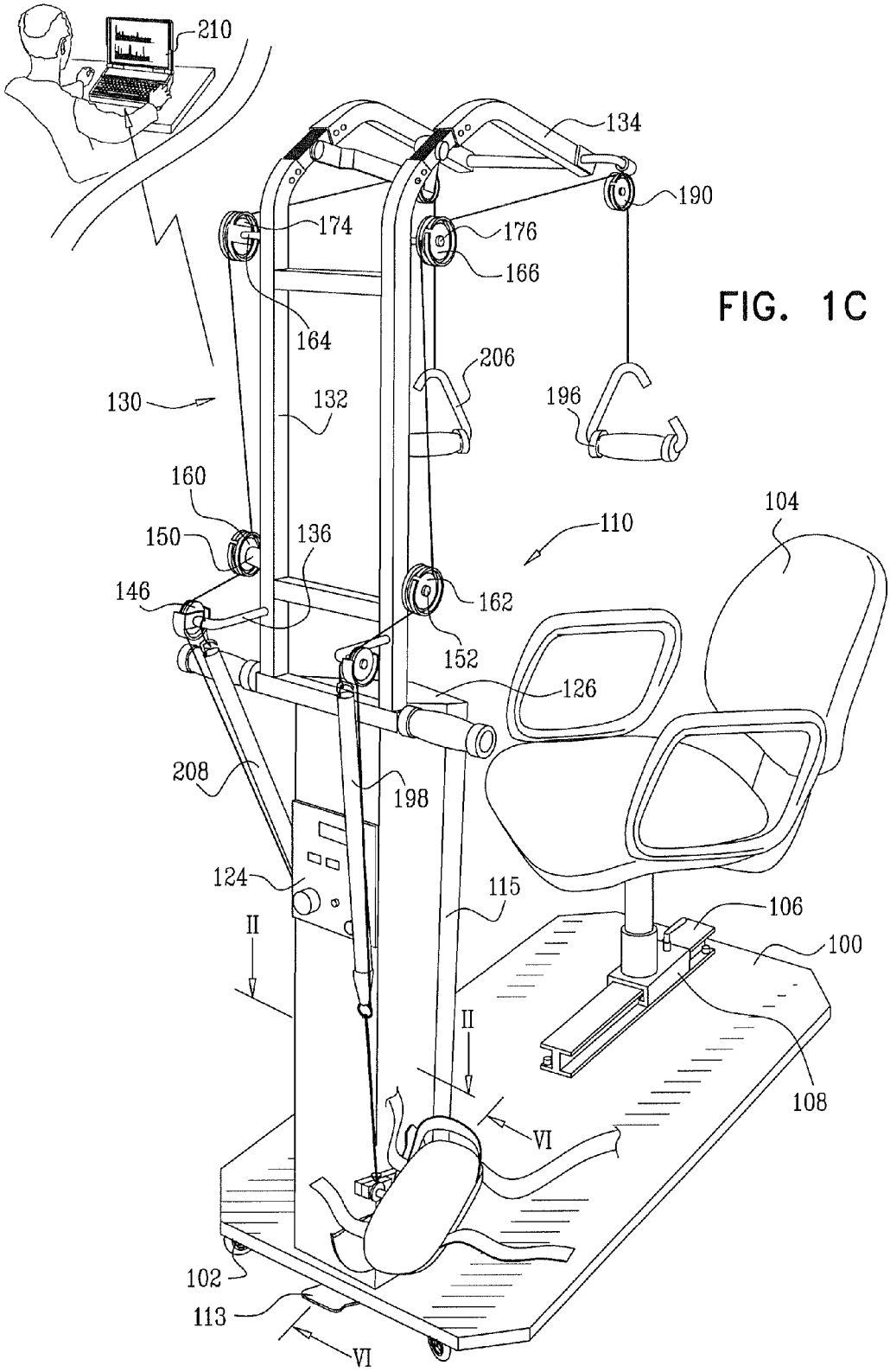
Figure 2:
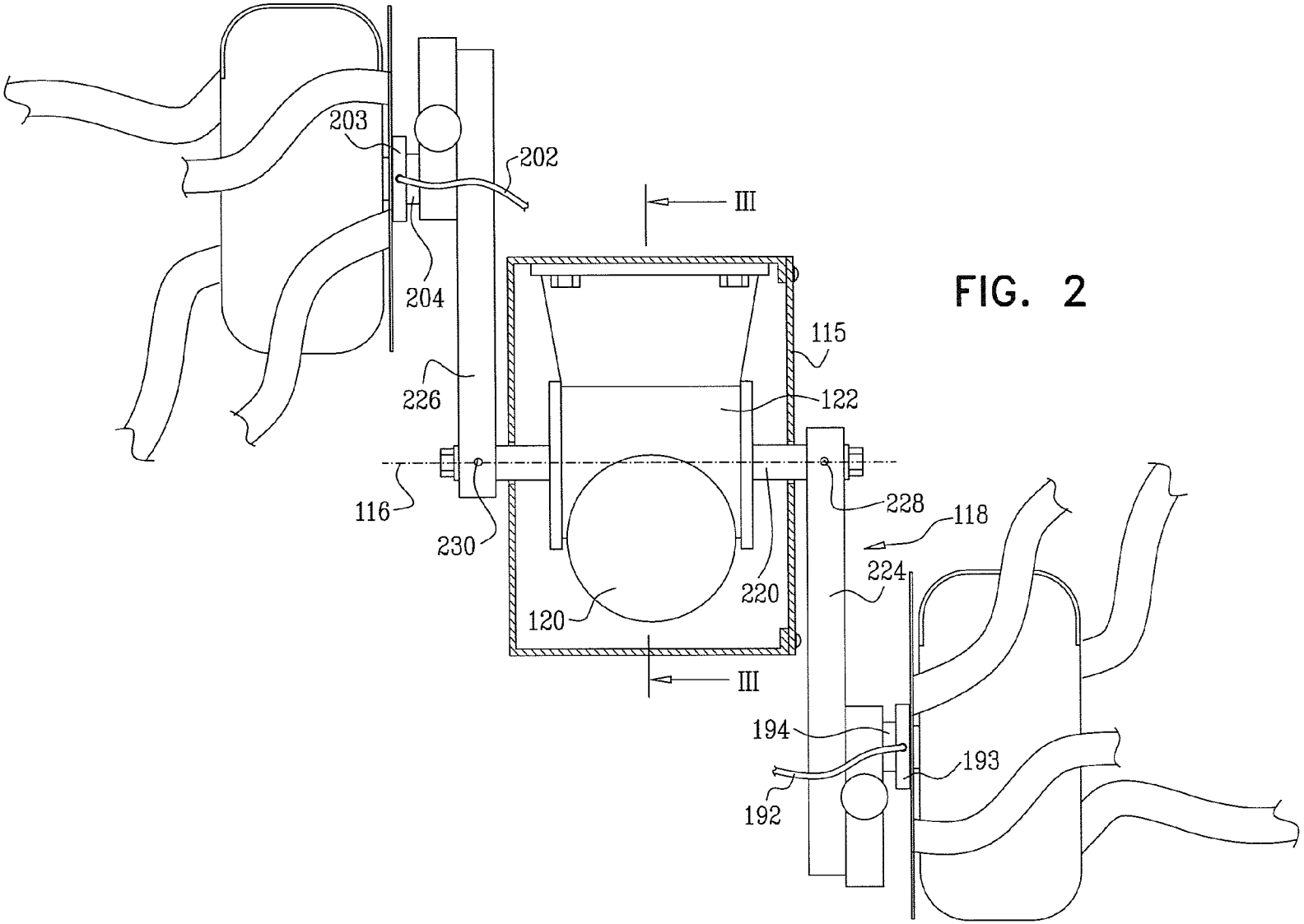
FIG. 2 is a simplified sectional illustration, taken along lines II-II in FIG. 1C, showing an arrangement of a foot pedal assembly forming part of the apparatus of FIGS. 1A-1C.
Figure 3:
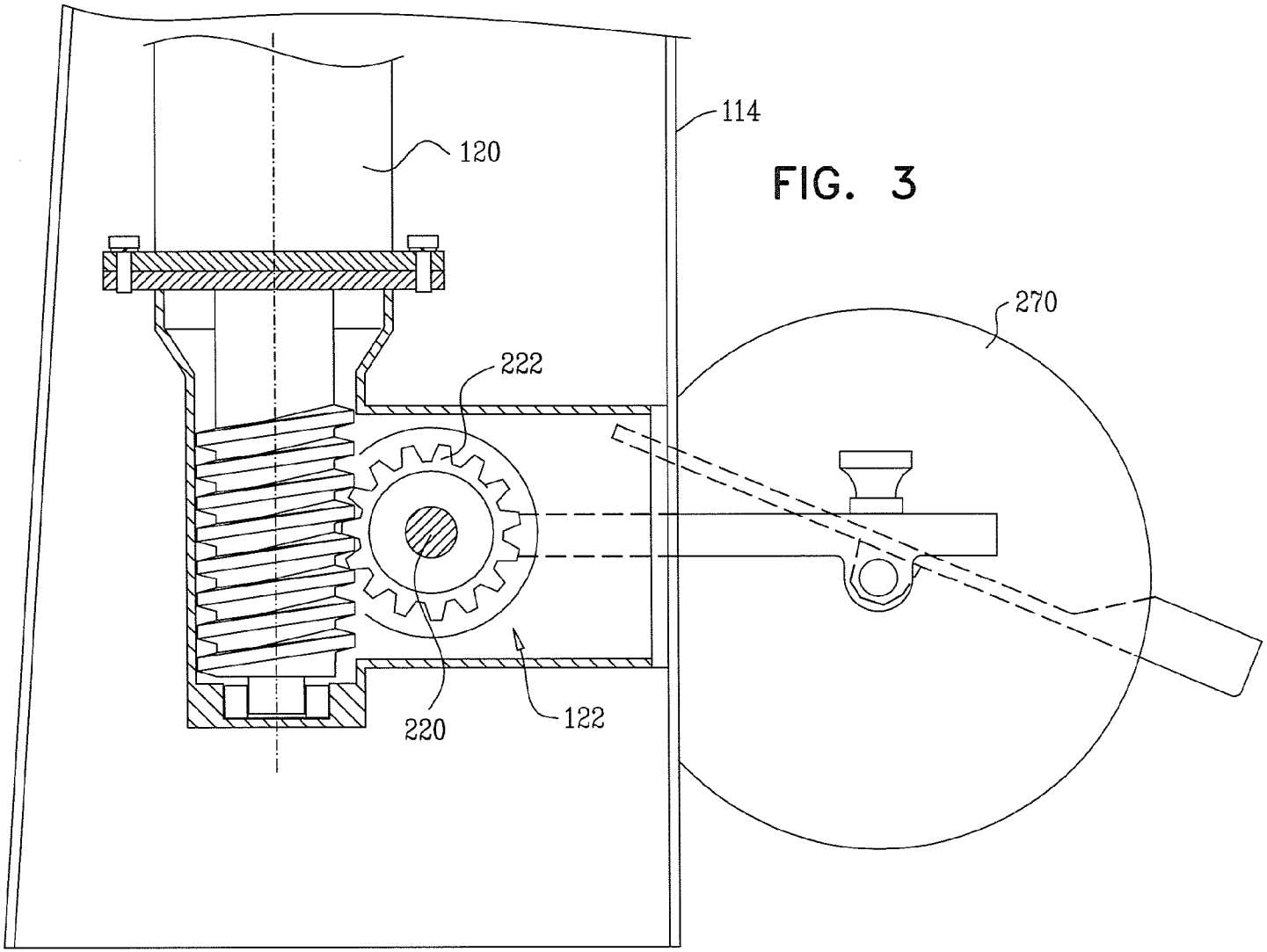
FIG. 3 is a simplified sectional illustration, taken along lines III-III in FIG. 2, showing the driving assembly of the foot pedal assembly.
Figure 4A:
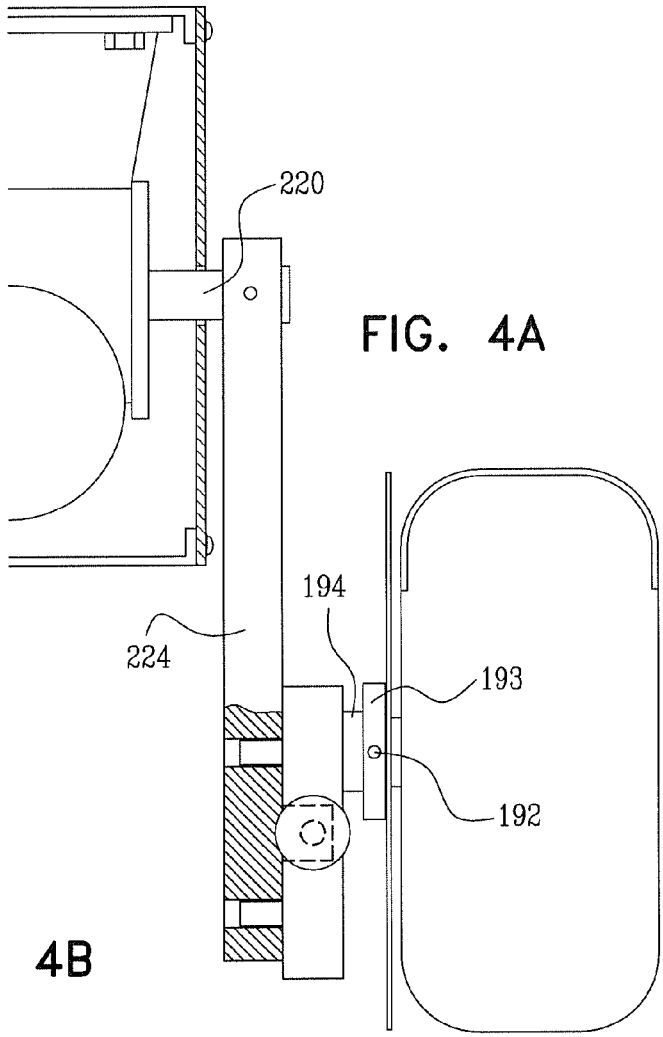
FIGS. 4A and 4B are simplified, partially cut away sectional illustrations of part of the foot pedal assembly of FIGS. 2 & 3 in respective first and second assembled operative orientations.
Figure 4B:
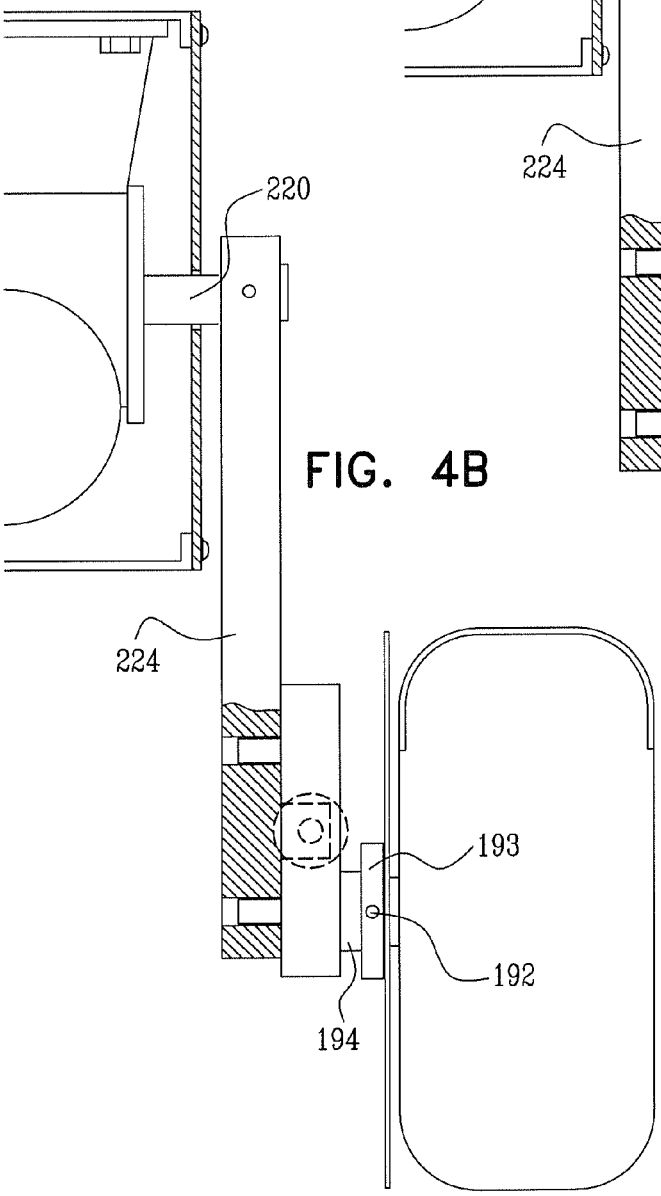
Figure 5A:
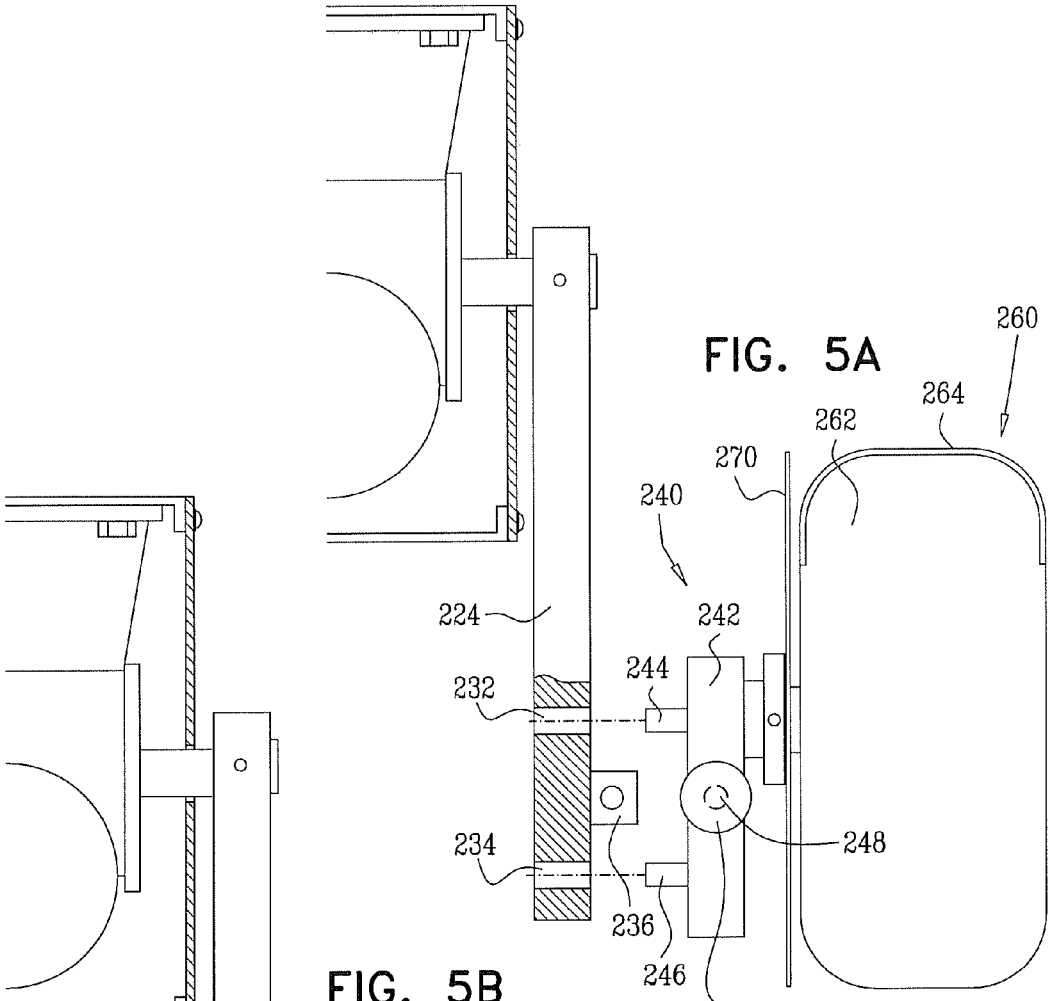
FIGS. 5A & 5B are simplified, partially cut away sectional illustrations of part of the foot pedal assembly of FIGS. 2 & 3 corresponding to FIGS. 4A & 4B but in a disassembled orientation.
Figure 5B:
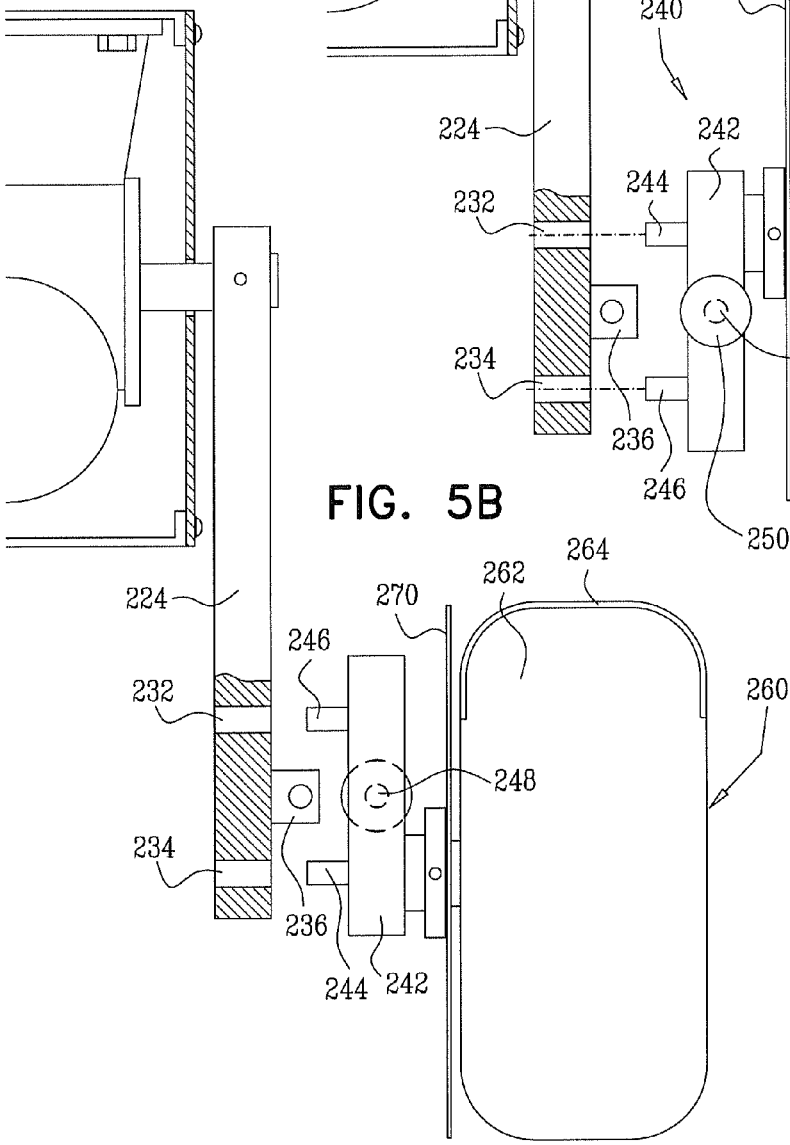

Reference is now made to FIGS. 1A, 1B & 1C, which together illustrate rehabilitation apparatus constructed and operative in accordance with a preferred embodiment of the present invention. As seen in FIGS. 1A, 1B & 1C, the rehabilitation apparatus of FIGS. 1A, 1B and 1C comprises a base 100, preferably mounted on casters 102. A patient chair 104 is selectably positionable on a mounting rail 106 fixed to base 100 by means of a mounting bracket 108 and is pivotable relative to mounting bracket 108 about a vertical axis 109.

A computer-controlled appendage displacement assembly 110 is mounted on base 100 and is preferably arranged for selectable positioning about a vertical axis 112, when released by depressing of a release pedal 113, so as to be able to accommodate wheelchair-bound patients. Release pedal 113 preferably includes a locking spring 114 operative to lock computer-controlled appendage displacement assembly 110 in the selected position when pedal 113 is not depressed. Selectable positioning of computer-controlled appendage displacement assembly 110 about axis 112 and locking thereof is described further hereinbelow in greater detail with reference to FIGS. 6A-6C.

The computer-controlled appendage displacement assembly 110 preferably comprises a chassis 115, which defines a pedal rotation axis 116 about which a foot pedal assembly 118 is arranged to rotate. Foot pedal assembly 118 is arranged to be driven by an electric motor 120 via a gear assembly 122, as described hereinbelow in greater detail with reference to FIGS. 2-5B.

The operation of electric motor 120 is governed by a computerized control assembly 123, which in turn interfaces with first and second operator control panels 124 and 126, the structure and operation of which are described hereinbelow with reference to FIGS. 7A & 7B.

Chassis 115 preferably includes handlebars 128 and supports a superstructure 130, including a generally vertical portion 132 and a selectably positionable top portion 134. Generally vertical portion 132 includes first and second pulley supports 136 and 138, onto which are mounted respective first and second pulleys 146 and 148, third and fourth pulley supports 150 and 152, onto which are mounted respective third and fourth pulleys 160 and 162, and fifth and sixth pulley supports 164 and 166, onto which are mounted respective fifth and sixth pulleys 174 and 176.

Selectably positionable top portion 134 includes seventh and eighth pulley supports 178 and 180, onto which are mounted respective seventh and eighth pulleys 188 and 190. The structure and operation of the seventh and eighth pulley supports 178 and 180, onto which are mounted respective seventh and eighth pulleys 188 and 190 and which together provide pivotable pulley assemblies, is described hereinbelow with reference to FIGS. 9A-10B and 15A-15D.

A first cable 192 interconnects a rotatable ring 193 on a first foot pedal axle 194 on foot pedal assembly 118 to a first hand hold assembly 196. Cable 192 preferably extends over and in engagement with pulley 148, under and in engagement with pulley 162, over and in engagement with pulley 176 and over and in engagement with pulley 190. A first tension spring 198, coupled at one end to cable 192 between axle 194 and pulley 148, and at an opposite end to pulley support 138, maintains tension in cable 192.

A second cable 202 interconnects a rotatable ring 203 on a second foot pedal axle 204 on foot pedal assembly 118 to a second hand hold assembly 206. Cable 202 preferably extends over and in engagement with pulley 146, under and in engagement with pulley 152, over and in engagement with pulley 174 and over and in engagement with pulley 188. A second tension spring 208, coupled at one end to cable 202 between axle 204 and pulley 146, and at an opposite end to pulley support 136, maintains tension in cable 202.

An output indication of user resistance to rotation of pedal assembly 118 may be provided by an ancillary computer 210, preferably in real-time, preferably in an operator readable form, such as a summary, for example a graph 212. Separate graphs may be provided to indicate resistance of opposite sides of a user's body.

Reference is now made to FIGS. 2-5B, which illustrate foot pedal assembly 118 forming part of the apparatus of FIGS. 1A-1C. It is seen that foot pedal assembly 118 includes a foot pedal assembly axle 220, which is fixed to a toothed gear 222, forming part of gear assembly 122 (FIGS. 1A-1C). First and second foot pedal support shafts 224 and 226 are mounted onto axle 220, and are fixed thereto for rotation therewith as by respective pins 228 and 230.

As seen particularly in FIGS. 4A, 4B, 5A and 5B, each of shafts 224 and 226 is preferably formed with a pair of thoroughgoing bores 232 and 234 and with a retaining pin socket 236. Bores 232 and 234 and retaining pin socket 236 are arranged to receive a foot pedal mounting assembly 240 in one of two possible orientations, illustrated in FIGS. 5A and 5B respectively, which allow for positioning of foot pedals at two different distances from axle 220.

Each foot pedal mounting assembly 240 comprises a base portion 242 having a pair of mutually spaced pins 244 and 246, arranged for removable mounting in respective bores 232 and 234, extending perpendicularly outward therefrom. A retaining pin 248 is removably retained in a socket 250 formed in base portion 242 and is configured for removable engagement with retaining pin socket 236.

First and second foot pedal axles 194 and 204 (FIGS. 1A-1C) are rotatably mounted onto respective ones of foot pedal mounting assemblies 240 and each supports thereon a foot pedal 260 including a base portion 262, a heel portion 264, a foot strap portion 266, an ankle strap portion 268 and a side guard plate 270, which prevents inadvertent engagement of a user's clothing with cables 192 or 202 during operation.

Figure 6A:
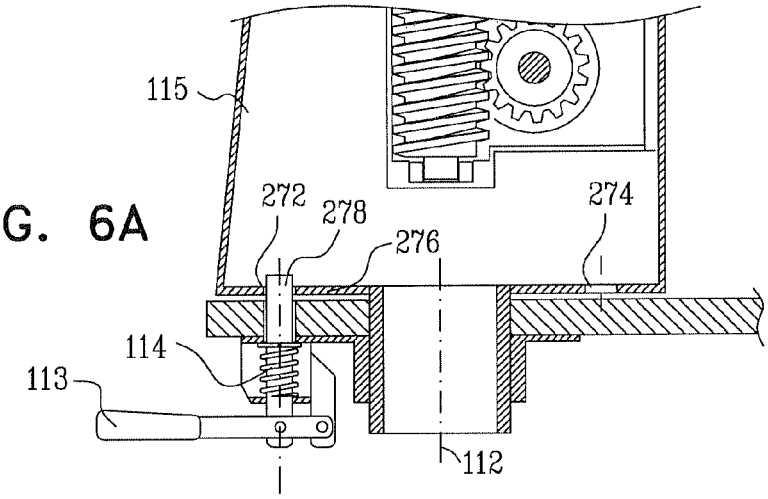
FIGS. 6A, 6B and 6C are simplified, partially cut away sectional illustrations, taken along lines VI-VI in FIG. 1C, of part of the apparatus of FIGS. 1A-1C illustrating rotatability of a chassis about a vertical axis between two alternative operative orientations.
Figure 6B:
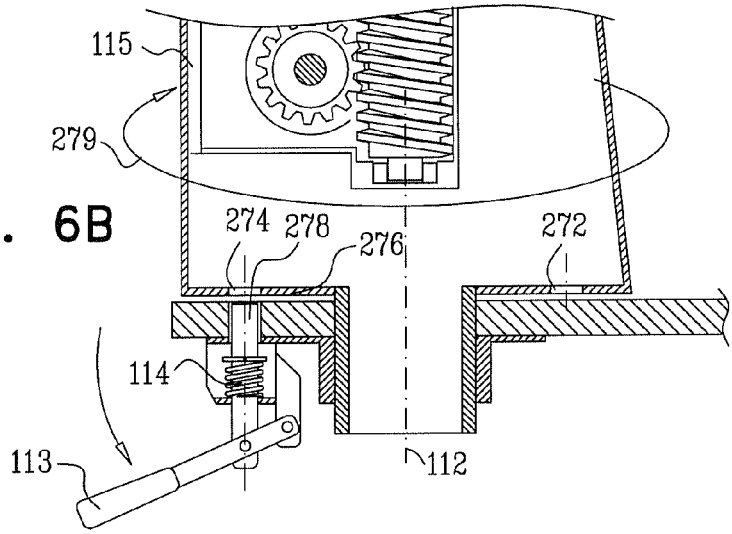
Figure 6C:
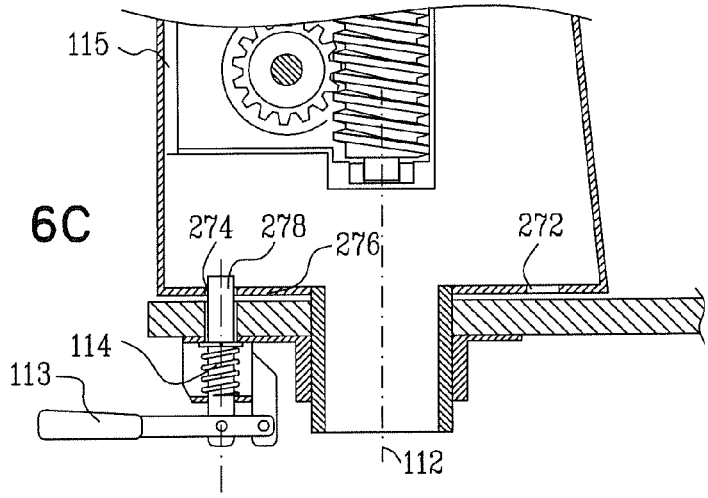

Reference is now made to FIGS. 6A, 6B and 6C, which are simplified, partially cut away sectional illustrations illustrating rotatability of chassis 115 about a vertical axis between two alternative operative orientations, so as to be able to accommodate wheelchair-bound patients.

As seen in FIGS. 6A, 6B and 6C, chassis 115 preferably includes two locking apertures 272 and 274 on a bottom surface 276 thereof, providing two respective locked positions for chassis 115. In the orientation shown in FIG. 6A, locking pin portion 278 of release pedal 113 engages locking aperture 272 and chassis 115 is locked in a first orientation allowing a user seated in chair 104 (FIG. 1A) to utilize the rehabilitation apparatus. As seen in FIG. 6B, when release pedal 113 is depressed, locking pin portion 278 is removed from locking engagement with locking aperture 272 and chassis 115 is rotated, as indicated by arrow 279, about axis 112, to a second operating orientation allowing a user seated in a wheelchair to utilize the rehabilitation apparatus. FIG. 6C shows the subsequent locking of chassis 115 in the second operating orientation by engagement of locking pin portion 278 with locking aperture 274 under pressure from spring 114 upon release of release pedal 113.

Figure 7A:
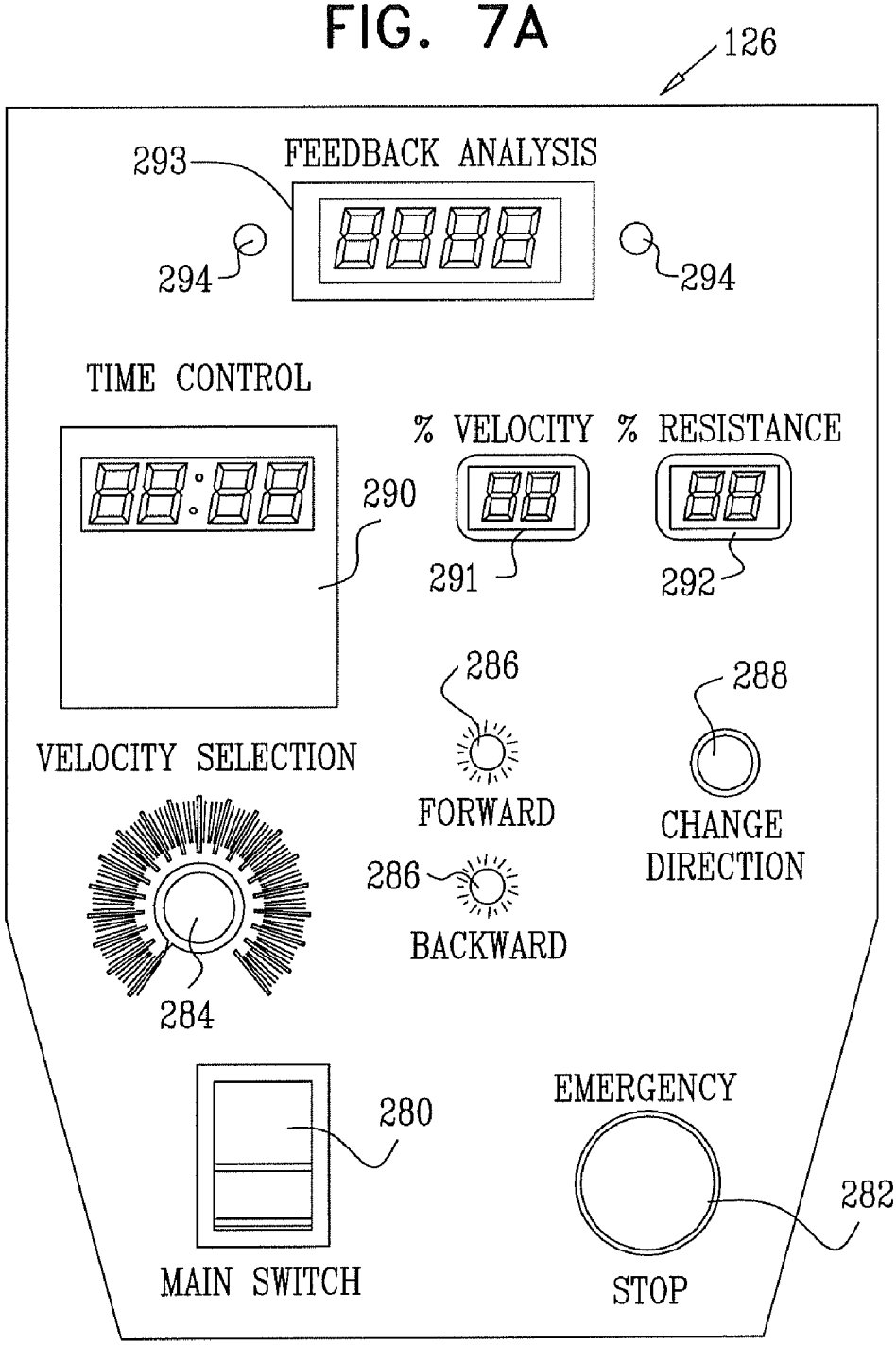
FIGS. 7A and 7B are simplified plan views illustration of first and second control panels employed in the apparatus of FIGS. 1A-1C.
Figure 7B:
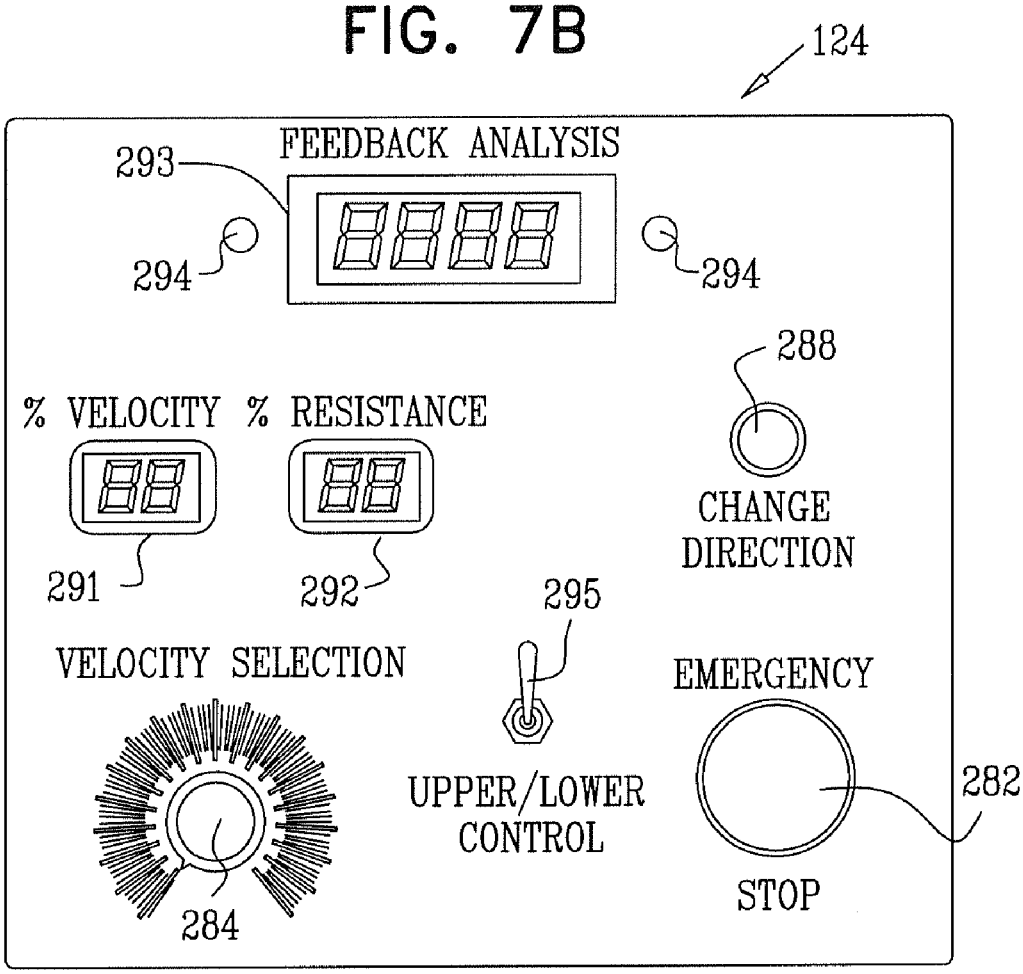

Reference is now made to FIGS. 7A and 7B, which are simplified plan views illustration of respective control panels 124 and 126, employed in the apparatus of FIGS. 1A-1C. Control panel 126 of FIG. 7A preferably is arranged on chassis 115 to face the user during operation and control panel 124 of FIG. 7B is arranged on chassis 115 to face away from the user and be viewable by an operator.

As seen in FIG. 7A, control panel 126 preferably includes some or all of a main switch 280, an emergency stop button 282 and a pedal assembly rotation velocity selection dial 284, which is preferably calibrated in units of % of maximum velocity. The control panel 126 preferably also includes forward and backward lights 286, for indicating the direction of rotation of the pedal assembly, and a change direction button 288 for changing the direction of rotation of the pedal assembly. One or more of the following displays may also be provided: a display 290 indicating the time remaining until termination of operation, which may be set by operator, a display 291 which indicates pedal assembly rotation velocity, which is preferably calibrated in units of % of maximum velocity and a display 292, which indicates resistance to rotation of the pedal assembly, preferably as derived by monitoring the current drawn by the motor 120 and processed by computerized control assembly 123 (FIGS. 1A-1C). Control panel 126 may also provide a feedback analysis display 293 providing an instantaneous indication of resistance to motor driven rotation of the pedal assembly. Lights 294 on opposite sides of display 293 illuminate to indicate whether the resistance relates to the left or right parts of a user's body.

As seen in FIG. 7B, control panel 124 may include some or all of the elements which are incorporated in FIG. 7A. Alternatively, control panel 124 may include some of the elements listed in the preceding paragraph, which may or may not be included in control panel 126. An upper/lower control switch 295 enables an operator to select which of control panels 124 and 126 governs operation of the system.

Figure 8A:
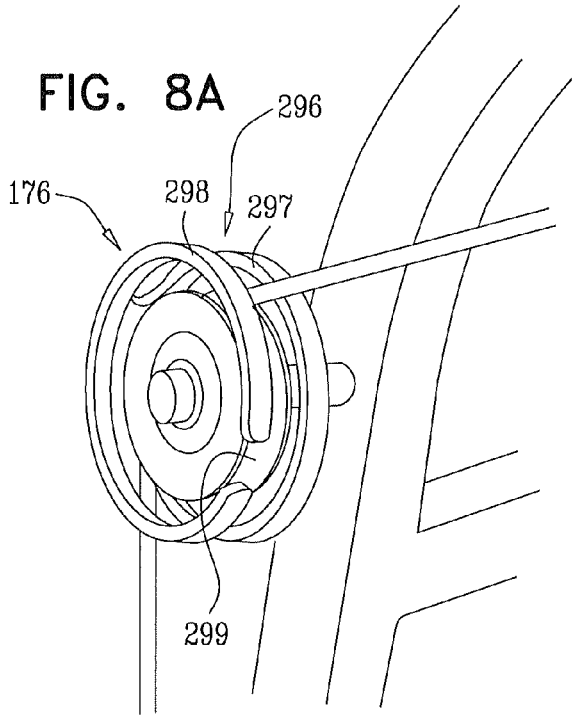
FIGS. 8A, 8B and 8C are simplified pictorial illustrations of a pulley assembly preferably forming part of the apparatus of FIGS. 1A-1C.
Figure 8B:
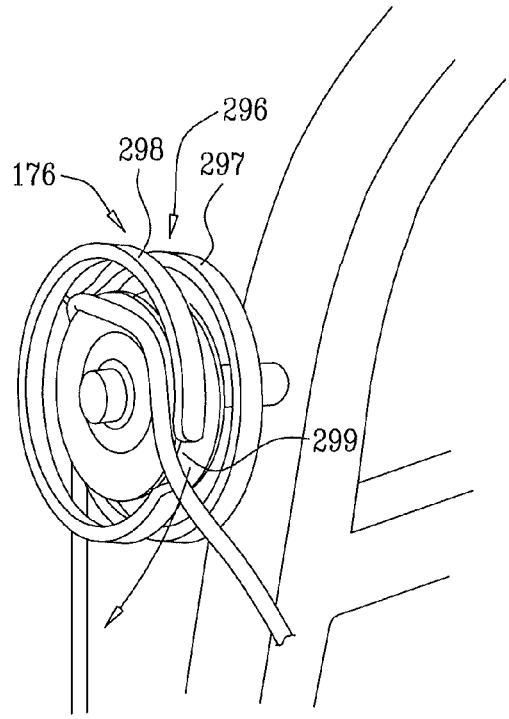
Figure 8C:
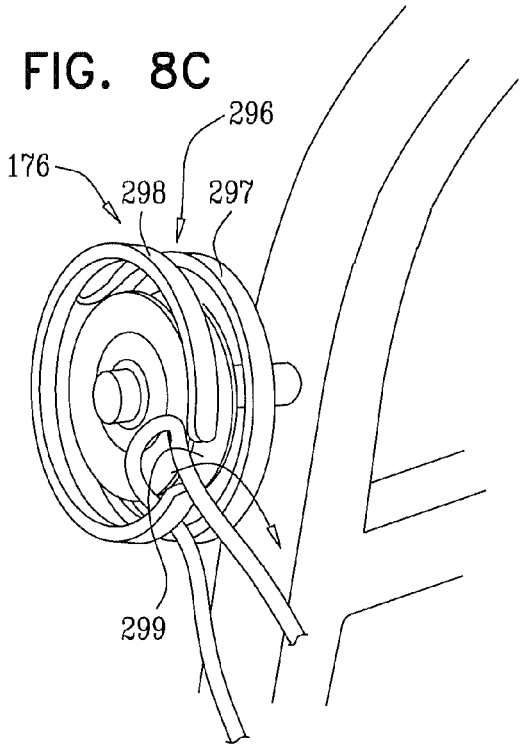

Reference is now made to FIGS. 8A, 8B and 8C, which illustrate the structure and operation of pulleys 174 and 176 and show pulley 176. As seen in FIGS. 8A, 8B and 8C, a pulley guard assembly 296 is associated with pulley 176 and fixed to pulley support 166 (FIGS. 1A-1C). Pulley guard assembly 296 preferably includes a first guard ring 297, which overlies an interior edge of pulley 176 and a partially open second guard ring 298 having an opening 299 which overlies an exterior edge of pulley 176. As seen in FIGS. 8A, 8B and 8C, cable 192 (FIGS. 1A-1C) can be selectably removed from engagement with pulley 176 via opening 299. This structure enables selectable disengagement of cables 192 and 202 from respective pulleys 176 and 174.

Reference is now made to FIGS. 9A-10B, which are simplified illustrations of pivotable pulley assembly 300, preferably forming part of the apparatus of FIGS. 1A-1C. As seen in FIGS. 9A-9B, the pivotable pulley assembly 300 preferably includes a pulley support 178 (FIGS. 1A-1C), onto which is pivotably mounted a pulley mount 302. Preferably a layer 304 of a low friction material, such as a layer of TEFLON® or DELRAN®, is interposed between an outer, cylindrical surface 306 of pulley mount 302 and an inner, cylindrical surface 308 of a mounting cylinder portion 310 of pulley mount 302.

Mounting cylinder portion 310 is preferably integrally formed with a pulley mount chassis 312 which includes a pulley mounting axle 314. A pulley 188 (FIGS. 1A-1C) is rotatably mounted onto pulley mounting axle 314, preferably on a low friction bearing 318, such as a cylinder formed of TEFLON®, OKOLON® or DELRAN®.

Figure 11A:
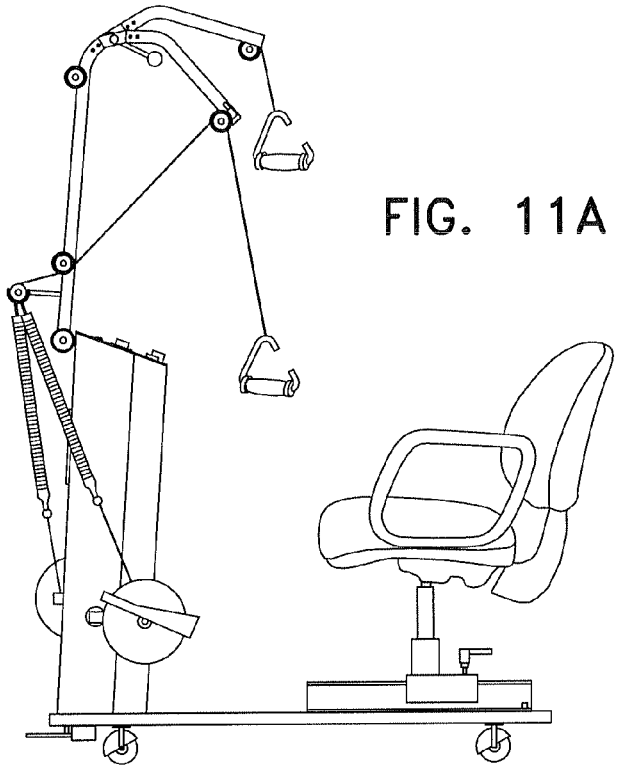
FIGS. 11A, 11B, 11C & 11D are simplified side view illustrations of four different operative orientations of the apparatus of FIGS. 1A-1C.
Figure 11B:
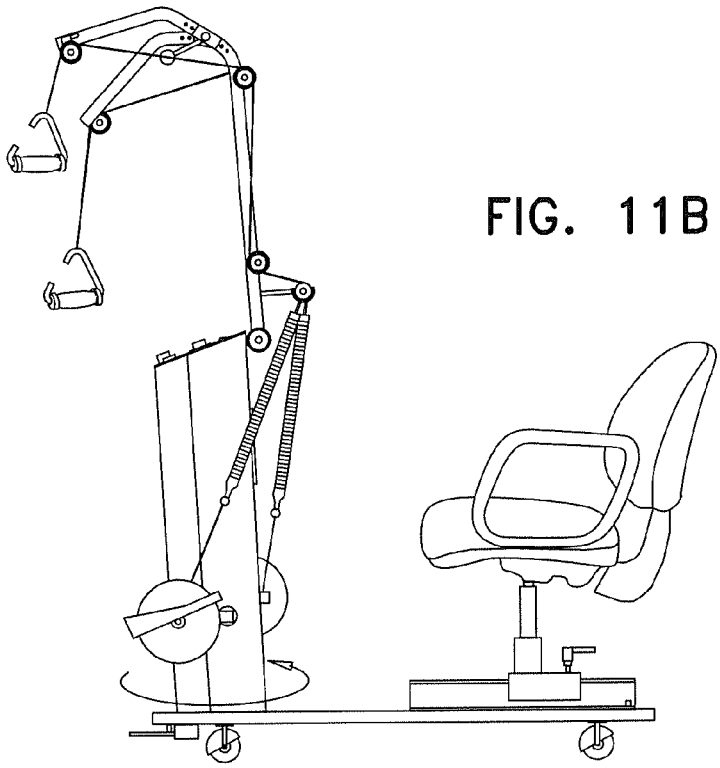
Figure 11C:
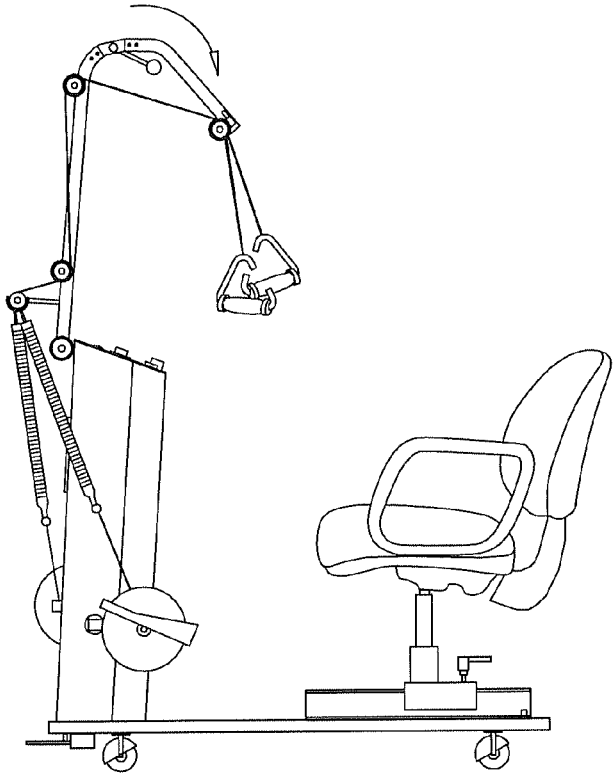
Figure 11D:
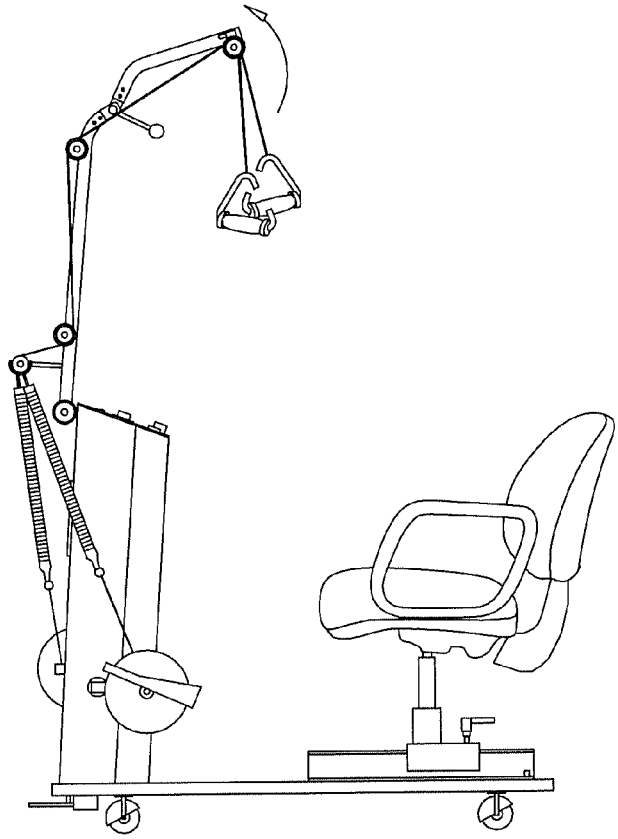

Reference is now made to FIGS. 11A, 11B, 11C & 11D, which are simplified side view illustrations of four different operative orientations of the apparatus of FIGS. 1A-1C. FIGS. 11A and 11B illustrate two alternative operative orientations of chassis 115, while FIGS. 11C and 11D illustrate two alternative orientations of top portion 134 relative to vertical portion 132 of the superstructure 130.

Figure 12:
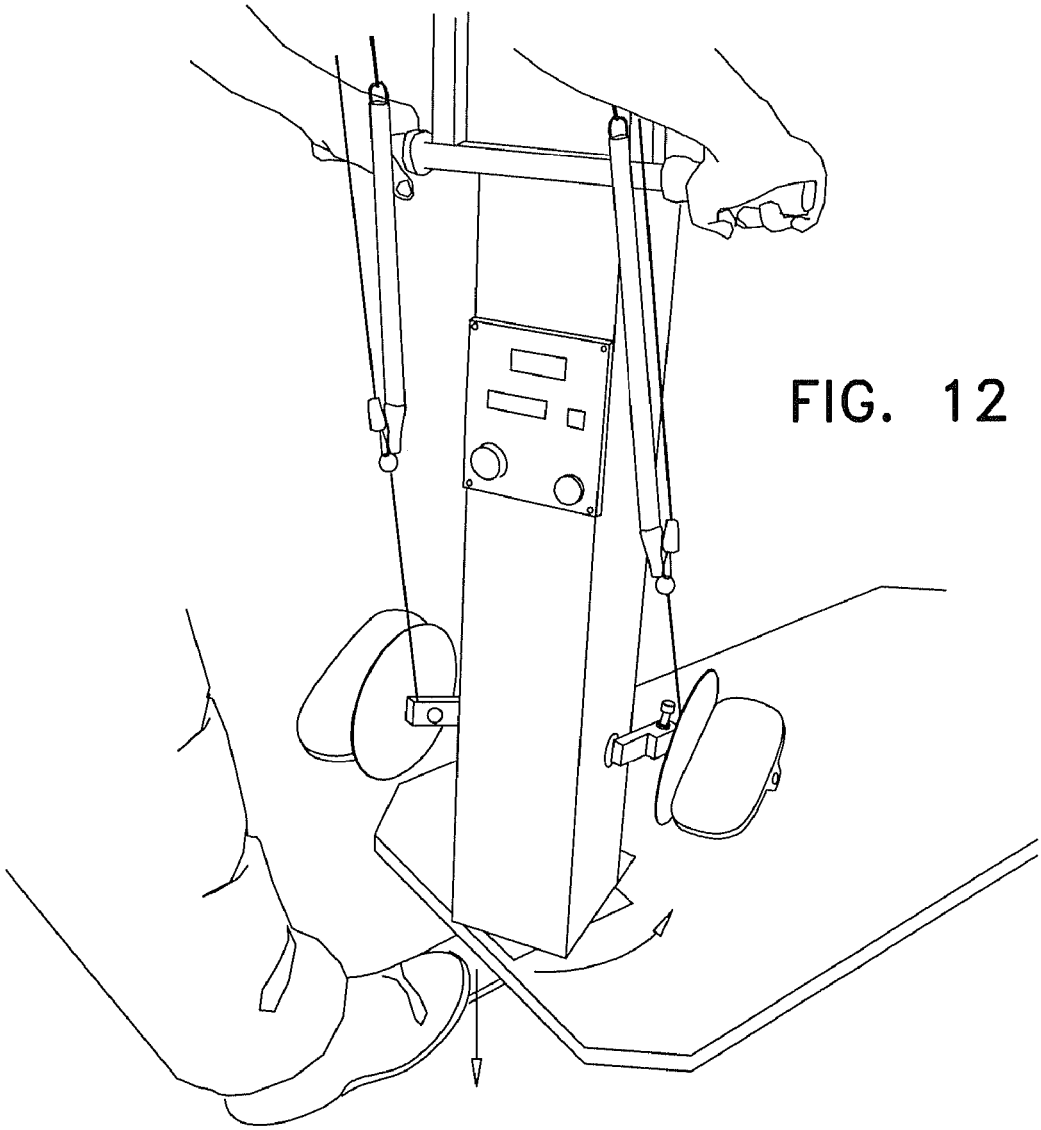
FIG. 12 is a simplified illustration which shows pivotable positioning of the chassis relative to the base in the apparatus of FIGS. 1A-1C.

FIG. 12 is a simplified illustration which shows pivotable positioning of the chassis 115 relative to the base in the apparatus of FIGS. 1A-1C between the orientations shown in FIGS. 11A and 11B, which is preferably achieved by an operator using his foot to depress pivot release lever 113 (FIGS. 1A-1C).

Figure 13:
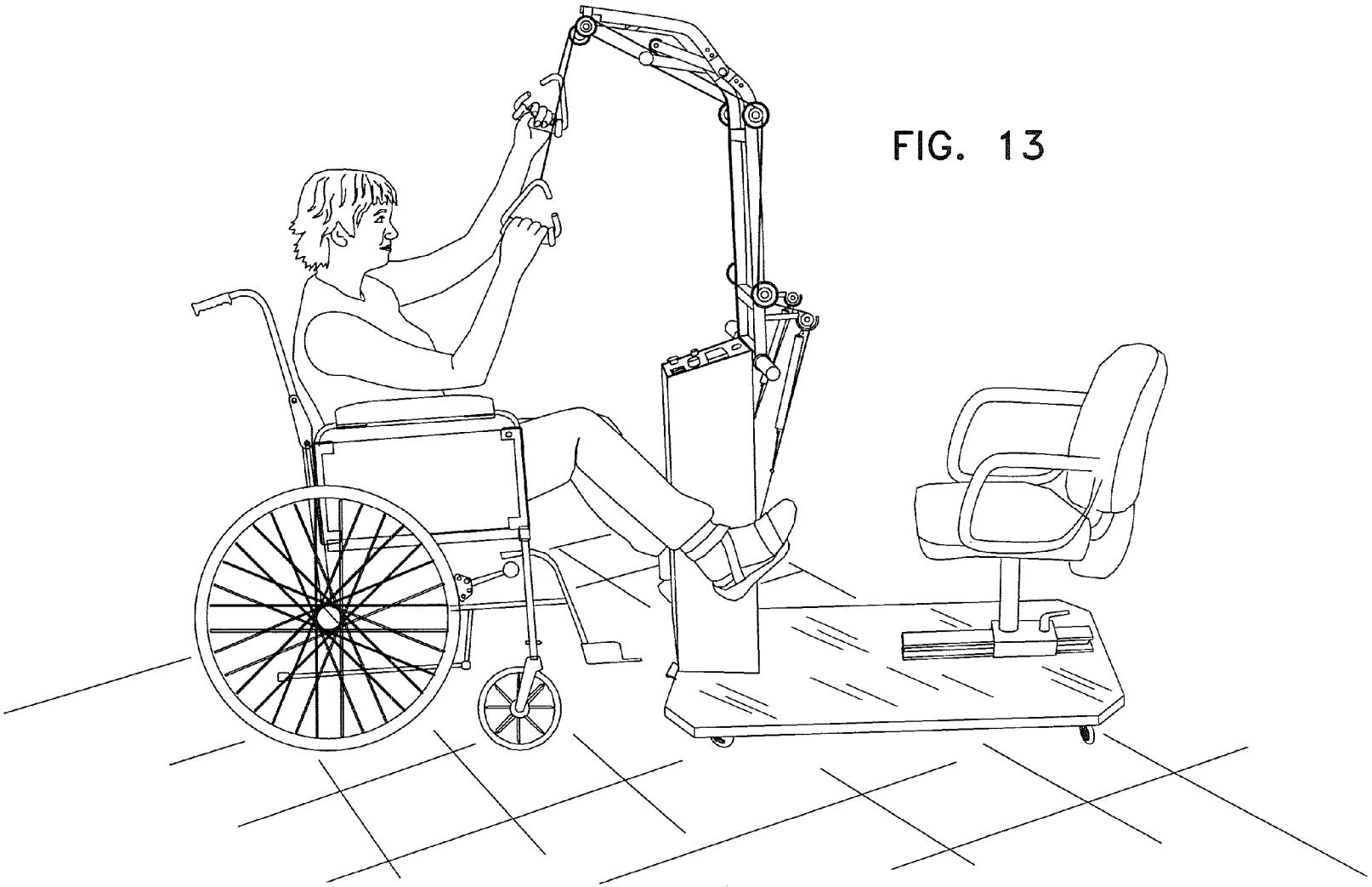
FIG. 13 illustrates operation of the apparatus of FIGS. 1A-1C in a first pivotable position of the chassis.
Figure 14A:
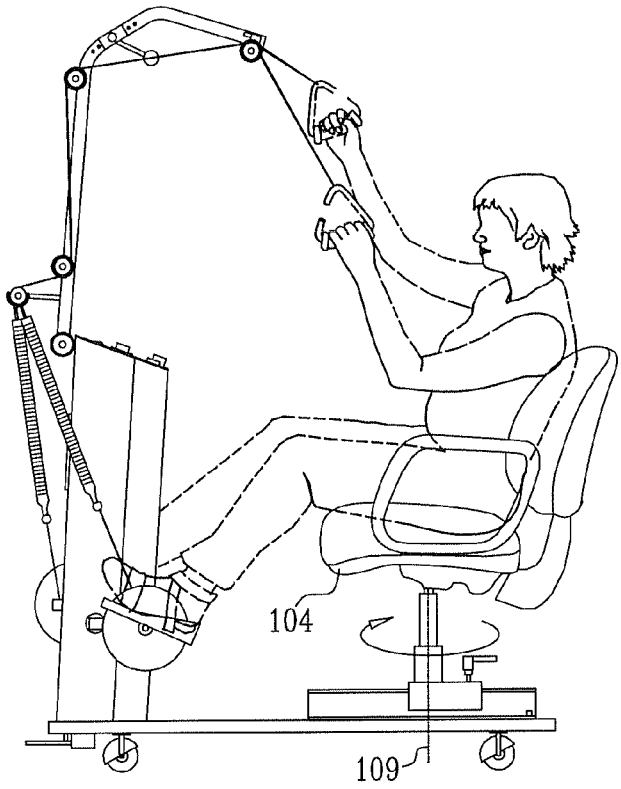
FIGS. 14A and 14B illustrate operation of the apparatus of FIGS. 1A-1C in a second pivotable position of the chassis.
Figure 14B:
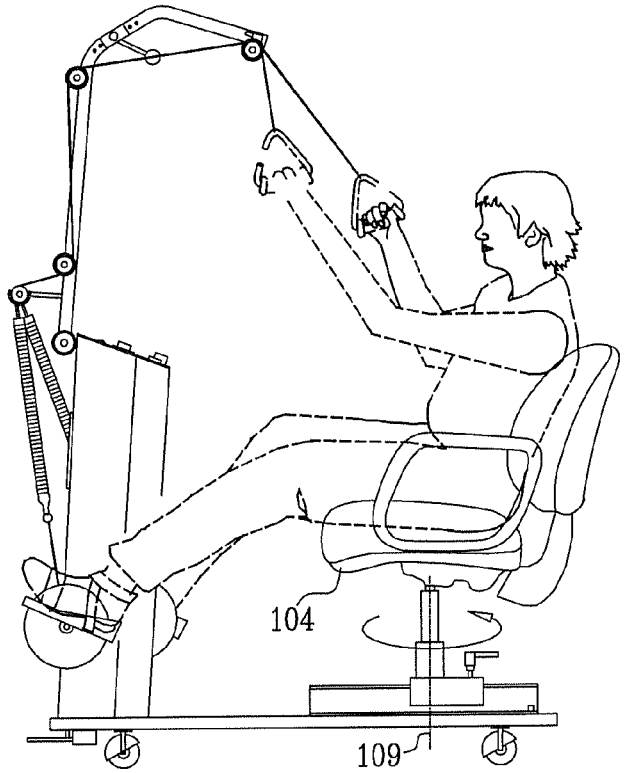

FIG. 13 illustrates operation of the apparatus of FIGS. 1A-1C in its FIG. 11B orientation. FIGS. 14A & 14B illustrates operation of the apparatus of FIGS. 1A-1C in its FIG. 11A orientation and show rotation of chair 104 about vertical axis 109 during operation to accommodate the natural motion of the user's body.

Figure 15A:
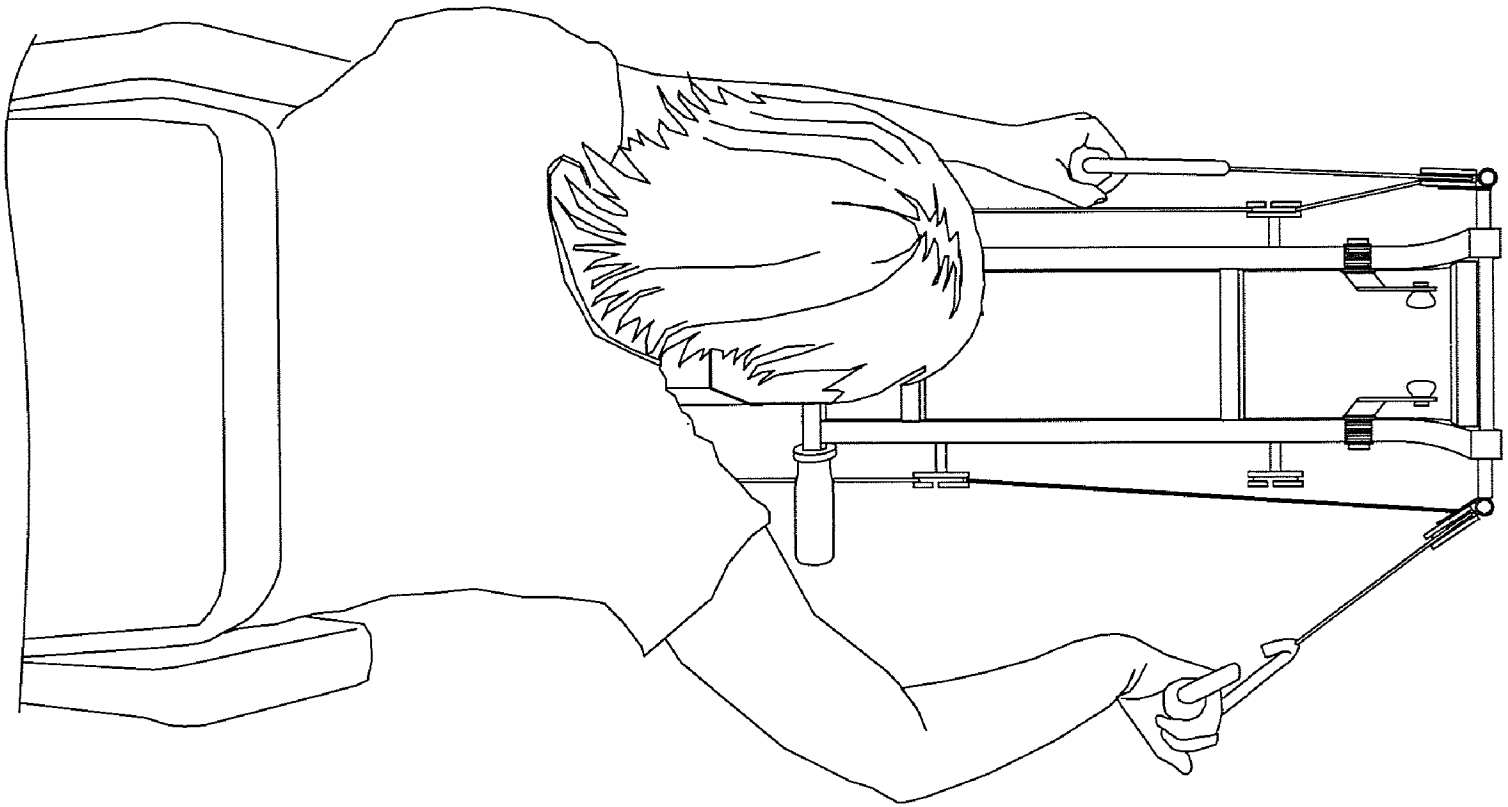
FIGS. 15A, 15B, 15C and 15D illustrate use of the pivotable pulley assembly of FIGS. 9A & 9B and a rotatably-mounted seat in the apparatus of FIGS. 1A-1C.
Figure 15B:
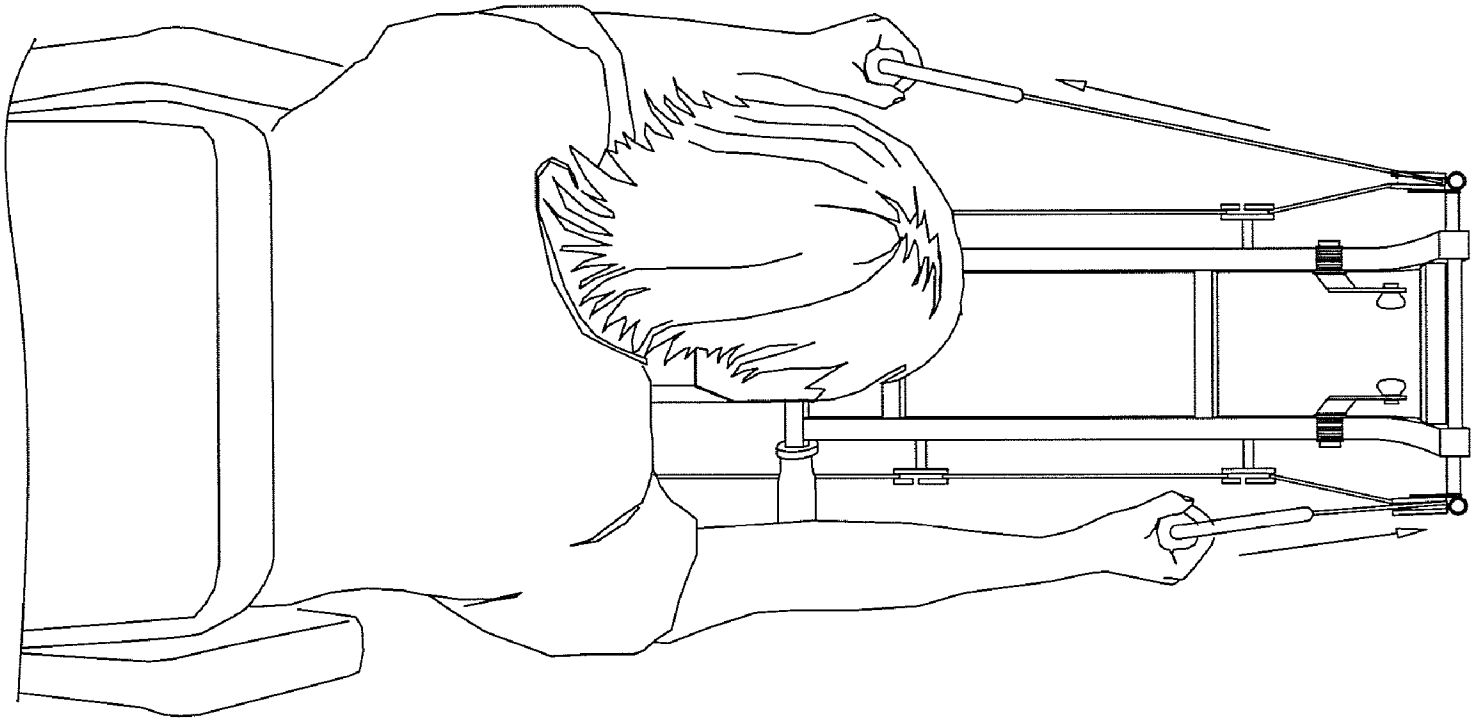

FIGS. 15A and 15B illustrate use of the pivotable pulley assembly of FIGS. 9A & 9B in the apparatus of FIGS. 1A-1C. The pivotable pulley assembly enables users having various appendage orientations to be readily accommodated.

Figure 15C:
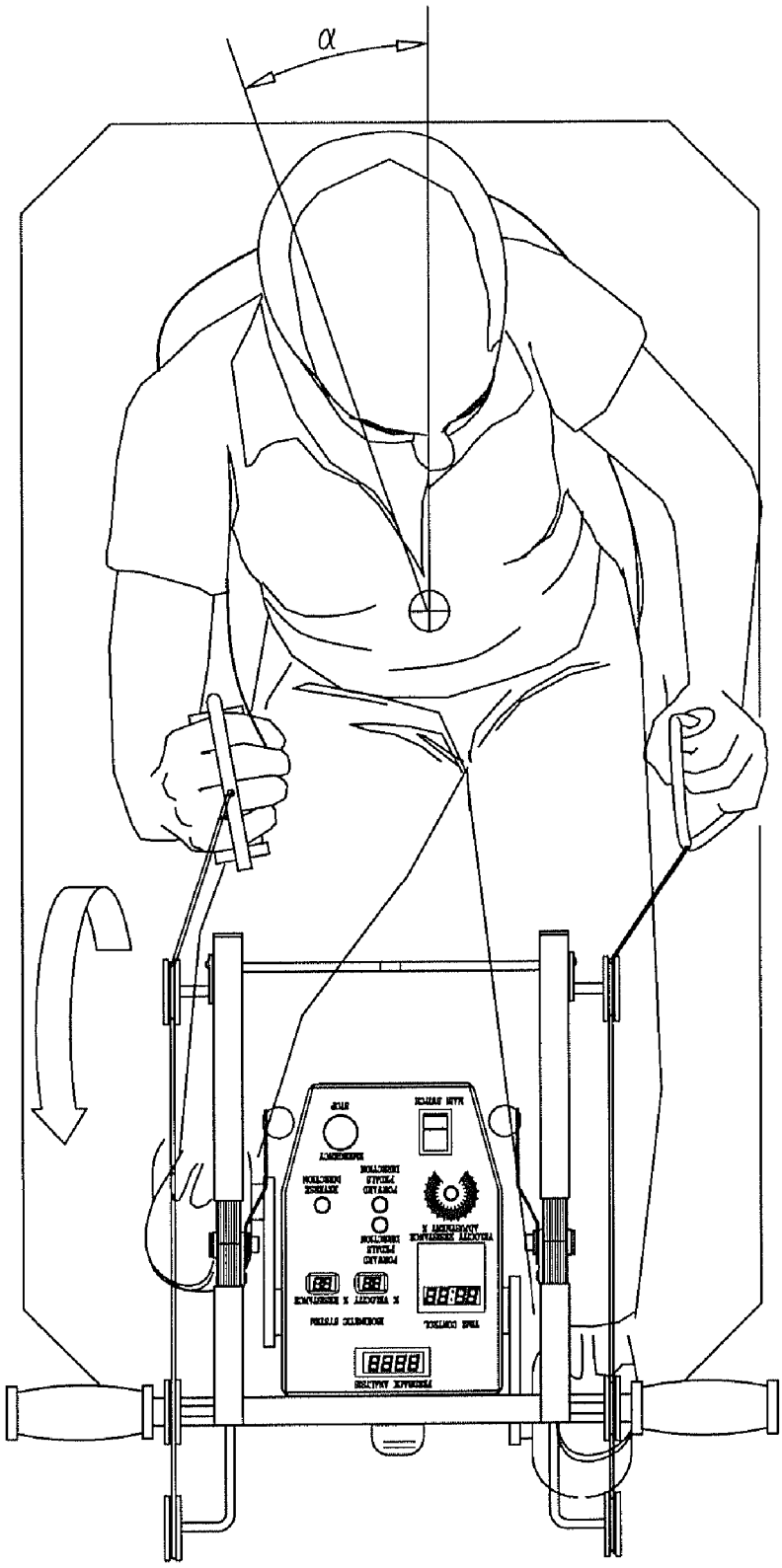
Figure 15D:
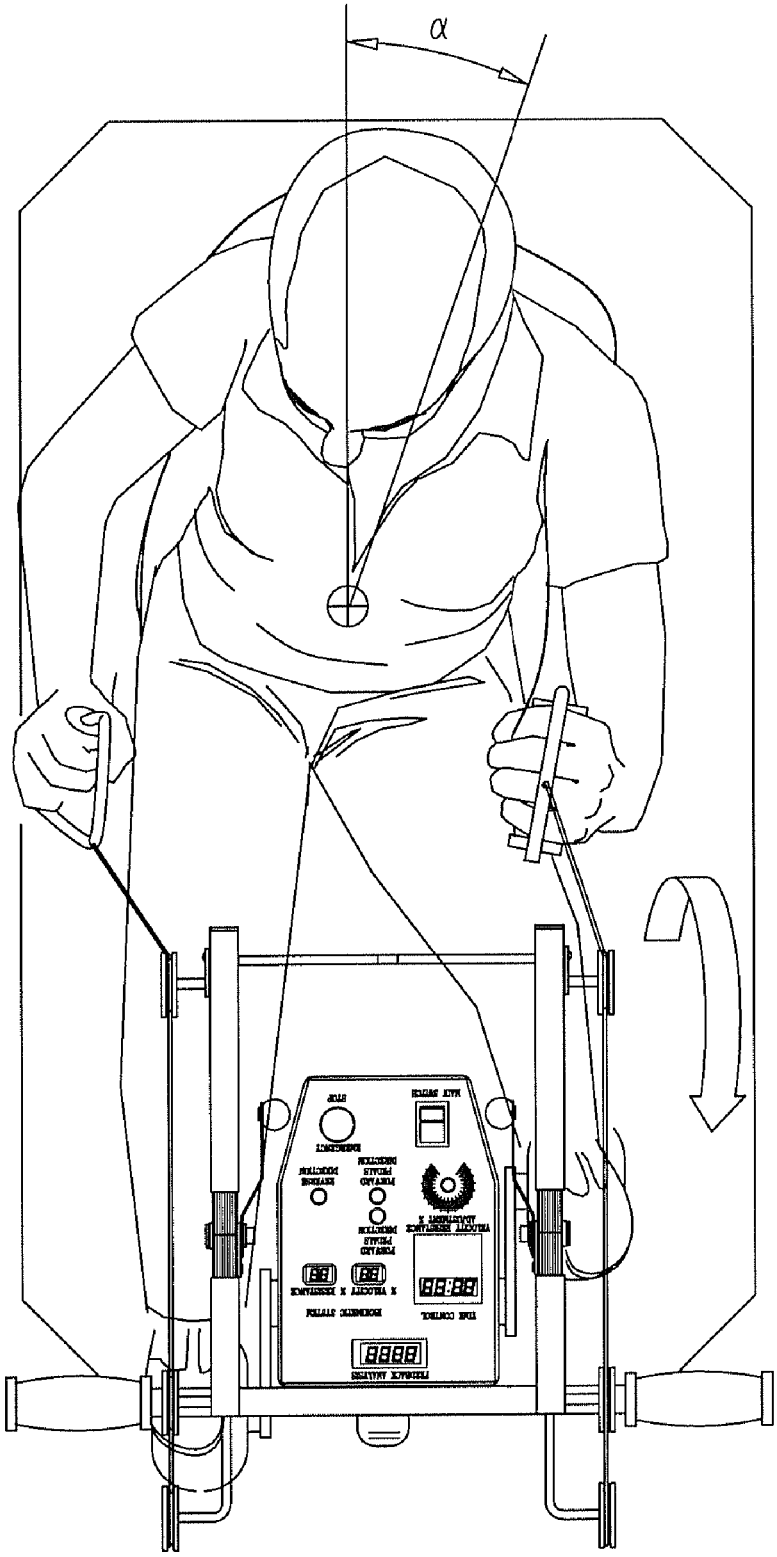

FIGS. 15C and 15D illustrate the use of the combined features of a pivotable seat, as illustrated in FIGS. 14A & 14B and the pivotable pulley assembly of FIGS. 9A & 9B. The provision of both of these features provides a synergistic benefit to many disabled users.

It will be appreciated by persons skilled in the art that the present invention is not limited by what has been particularly shown and described hereinabove. Rather the scope of the present invention includes both combinations and subcombinations of various features described hereinabove as well as modifications and variations thereof which would occur to persons skilled in the art upon reading the foregoing description and which are not in the prior art.

The invention claimed is:

1. Isokinetic rehabilitation apparatus comprising:

a chassis including a lower portion and an upper portion;

a motor-driven pedal assembly having associated therewith a pair of foot pedals and at least one hand engagement element mounted onto said chassis;

a computerized motor controller operative to drive said motor-driven pedal assembly at a generally constant, selectable speed, generally irrespective of the extent to which forces are applied to the pedal assembly, pulleys mounted both on said lower portion and on said upper portion; and at least one cable extending in engagement with said pulleys connecting said at least one hand engagement element with at least one of said pair of foot pedals, at least one of said pulleys being constructed to permit disengagement of said at least one cable with said pulley, thereby changing an effective length of said at least one cable.

2. Isokinetic rehabilitation apparatus according to claim 1 and also comprising a base, configured to rest on a flat surface and wherein said chassis is selectably pivotable with respect to said base.

3. Isokinetic rehabilitation apparatus-according to claim 1 and also comprising a base; and a seat, wherein said chassis is mounted on said base, and said seat is selectably horizontally positionable with respect to said base and rotatable with respect to said base.

4. Isokinetic rehabilitation apparatus according to claim 3 and wherein said chassis is selectably pivotable with respect to said base.

5. Isokinetic rehabilitation apparatus according to claim 4 and wherein said chassis is selectably pivotable with respect to said base between a first operative orientation, wherein said at least one hand engagement element is located between said chassis and said seat, and a second operative orientation, wherein said at least one hand engagement element is located on an opposite side of said chassis from said seat.

6. Isokinetic rehabilitation apparatus according to claim 1 and wherein said motor-driven pedal assembly comprises:

a foot pedal assembly axle, which is fixed to a toothed gear, driven in motion by a motor;

first and second foot pedal support shafts, mounted onto said foot pedal assembly axle; and first and second foot pedal mounting assemblies which rotatably support foot pedals and which are mountable onto said first and second foot pedal support shafts in two possible orientations, which correspond to positions of said foot pedals at two different distances from said foot pedal assembly axle.

7. Isokinetic rehabilitation apparatus according to claim 1 and wherein said computerized motor controller is operative to provide an output indication of resistance to rotation of said motor-driven pedal assembly at a generally constant speed.

8. Isokinetic rehabilitation apparatus according to claim 7 and wherein said output indication is a real time operator readable output indication.

9. Isokinetic rehabilitation apparatus according to claim 7 and wherein said output indication is a summary operator readable output indication.

10. Isokinetic rehabilitation apparatus according to claim 1 whereby rotational motion of said foot pedal assembly results in reciprocal motion of said at least one hand engagement element along a reciprocal motion axis, and wherein at least one of said pulleys, being closest to said at least one hand engagement element, is rotatable relative to said chassis about at least first and second mutually orthogonal axes.

* * * * *

UNITED STATES PATENT AND TRADEMARK OFFICE

CERTIFICATE OF CORRECTION

PATENT NO. : 7,717,824 B2
APPLICATION NO. : 11/937314
DATED : May 18, 2010
INVENTOR(S) : Itzhak Pinto It is certified that error appears in the above-identified patent and that said Letters Patent is hereby corrected as shown below:

Claim 3, line 1 (column 8, line 1) – delete "apparatus-according" and insert -- apparatus according --

Signed and Sealed this

Twenty-third Day of November, 2010

David J. Kappos

David J. Kappos
*Director of the United States Patent and Trademark Office*